US006626736B2

(12) United States Patent
Tsujimura et al.

(10) Patent No.: US 6,626,736 B2
(45) Date of Patent: Sep. 30, 2003

(54) POLISHING APPARATUS

(75) Inventors: Manabu Tsujimura, Yokohama (JP); Norio Kimura, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/893,625

(22) Filed: Jun. 29, 2001

(65) Prior Publication Data

US 2002/0013124 A1 Jan. 31, 2002

(30) Foreign Application Priority Data

Jun. 30, 2000 (JP) ..... 2000-199923

(51) Int. Cl.[7] ..... B24B 1/00

(52) U.S. Cl. ..... 451/9; 451/10; 451/11; 451/41; 451/307

(58) Field of Search ..... 451/41, 6, 9, 10, 451/11, 63, 307, 299

(56) References Cited

U.S. PATENT DOCUMENTS 6,244,935 B1 * 6/2001 Birang et al. ..... 451/41
6,475,070 B1 * 11/2002 White ..... 451/59

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus is used for polishing a workpiece such as a semiconductor wafer to a flat mirror finish, and allows a polishing pad to be automatically replaced without stopping rotary or circulatory motion of a polishing table. The polishing apparatus comprises a polishing table for making rotary or circulatory motion, a top ring vertically movably disposed above the polishing table for removably holding a workpiece to be polished, a pair of rolls rotatable about their own axes and movable in unison with the polishing table, and a polishing pad which is wound on one of the rolls and supplied over an upper surface of the polishing table toward the other of the rolls.

16 Claims, 15 Drawing Sheets

POLISHING APPARATUS

BACKGROUND OF THE INVENTION

1. Field of the Invention

The present invention relates to a polishing apparatus for polishing a workpiece such as a semiconductor wafer to a flat mirror finish, and more particularly to a rotary-type polishing apparatus which allows a polishing pad to be automatically replaced without stopping rotary or circulatory motion of a polishing table.

2. Description of the Related Art

Recent rapid progress in semiconductor device integration demands smaller and smaller wiring patterns or interconnections and also narrower spaces between interconnections which connect active areas. One of processes available for forming such interconnections is photolithography. Though a photolithographic process can form interconnections that are at most 0.5 $\mu$m wide, it requires that surfaces on which pattern images are to be focused by a stepper be as flat as possible because depth of focus of an optical system is relatively small.

It is therefore necessary to make surfaces of semiconductor wafers flat for photolithography. One customary way of flattening surfaces of semiconductor wafers is to polish them with a polishing apparatus, and such a process is called Chemical Mechanical Polishing (CMP) in which semiconductor wafers are chemically and mechanically polished while supplying a polishing liquid comprising abrasive grains and chemical solution such as alkaline solution.

In a manufacturing process of a semiconductor device, a thin film is formed on a semiconductor device, and then micromachining processes, such as patterning or forming holes, are performed thereon. Thereafter, the above processes are repeated to form thin films on the semiconductor device. Recently, semiconductor devices have become more integrated, and structure of semiconductor elements has become more complicated. In addition, the number of layers in multilayer interconnections used for a logical system has been increased. Therefore, irregularities on a surface of a semiconductor device are increased, so that step height on the surface of the semiconductor device becomes larger.

When irregularities of a surface of a semiconductor device are increased, the following problems arise. Thickness of a film formed in a portion having a step is relatively small. An open circuit is caused by disconnection of interconnections, or a short circuit is caused by insufficient insulation between layers. As a result, good products cannot be obtained, and yield is lowered. Further, even if a semiconductor device initially works normally, reliability of the semiconductor device is lowered after a long-term use.

Thus, during a manufacturing process of a semiconductor device, it is increasingly important to planarize a surface of the semiconductor device. The most important one of planarizing technologies is chemical mechanical polishing (CMP). During chemical mechanical polishing, a polishing apparatus is employed. While a polishing liquid containing abrasive particles such as silica ($SiO_2$) therein is supplied onto a polishing surface such as a polishing pad, a substrate such a semiconductor wafer is brought into sliding contact with the polishing surface, so that the substrate is polished.

FIGS. 16 and 17 of the accompanying drawings show a conventional polishing apparatus for carrying out a CMP process. As shown in FIGS. 16 and 17, the conventional polishing apparatus comprises a polishing table 102 having a polishing pad (polishing cloth) 100 attached to its upper surface, a motor 104 for rotating the polishing table 102, and a vertically movable top ring 106 for holding a substrate W such as a semiconductor wafer with its surface, to be polished, facing the polishing pad 100. While the polishing table 102 and the top ring 106 are being rotated independently about their own axes, the substrate W is pressed against the polishing pad 100 under a constant pressure by the top ring 106, and a polishing liquid is supplied from a nozzle (not shown) to the polishing pad 100, thereby polishing the surface of the substrate W to a flat mirror finish. The polishing liquid comprises fine abrasive particles of silica or the like suspended in an alkaline solution or the like. The substrate W is polished by a chemical mechanical polishing action which is a combination of a chemical polishing action performed by the alkaline solution and a mechanical polishing action performed by the abrasive particles of silica or the like.

The polishing pad 100 is usually regenerated by a dresser which comprises a nylon brush, diamond particles, or the like. When the polishing pad 100 is worn to an extent that its polishing capability can no longer be restored by the dresser, the polishing pad 100 is replaced with a new one.

The polishing pad 100 is generally attached to an upper surface of the polishing table 102 by an adhesive tape. For replacing the polishing pad 100 with a new one, it is necessary to temporarily stop a CMP process, and a skilled operator is required to peel off the polishing pad 100 and attach a new polishing pad 100 to the polishing table 102.

FIG. 18 of the accompanying drawings shows another conventional polishing apparatus for eliminating the above drawbacks. The polishing apparatus shown in FIG. 18 has a polishing pad 100 attached to a polishing table 102 under vacuum developed by a vacuum attraction section 108 provided in the polishing table 102. Since the polishing pad 100 is removed from the polishing table 102 by releasing the vacuum, the polishing pad 100 can easily and quickly be replaced with a new one. However, replacing the polishing pad 100 requires temporarily stopping a CMP process because the polishing pad cannot be replaced while the polishing pad table 102 is rotating.

Still another conventional polishing apparatus is shown in FIG. 19 of the accompanying drawings. In FIG. 19, a polishing table 110 is fixed in position, and a pair of rolls 112, 114 are rotatably disposed one on each side of the polishing table 110. An elongate polishing pad 116 wound onto the roll 112 is continuously fed at a constant speed along an upper surface of the polishing table 110, and beneath a substrate W, toward the other roll 114 onto which the polishing pad 116 is wound. The substrate W is polished by the elongate polishing pad 116 as the polishing pad travels over the polishing table 110 in one direction. Principles of the polishing apparatus shown in FIG. 19 are not applicable to a rotary-type polishing apparatus in which a polishing table makes rotary or circulatory motion.

SUMMARY OF THE INVENTION

It is therefore an object of the present invention to provide a rotary-type polishing apparatus which has a polishing table that makes rotary or circulatory motion, and which allows a polishing pad to be automatically replaced without stopping a CMP process.

Another object of the present invention is to provide a polishing apparatus which has a polishing table that makes predetermined motion, and which allows a polishing pad to be automatically replaced without stopping a CMP process.

According to a first aspect of the present invention, there is provded a polishing apparatus comprising: a polishing table for making rotary or circulatory motion; a top ring vertically movably disposed above the polishing table for removably holding a workpiece to be polished; a pair of rolls rotatable about their own axes and movable in unison with the polishing table; and a polishing pad which is wound on one of the rolls and supplied over an upper surface of the polishing table toward the other of the rolls.

Even when the polishing table is in rotary or circulatory motion, the polishing pad can be transported from one of the rolls over the upper surface of the polishing table toward the other roll by a distance corresponding to a region of the polishing pad that has been used to polish workpieces. A used region of the polishing pad can thus automatically be replaced with a new region thereof.

In a preferred aspect of the present invention, the polishing table has an attraction section for attracting and holding the polishing pad to the polishing table.

In a preferred aspect of the present invention, the polishing apparatus further comprises a roll motor connected to at least the other of the rolls, wherein the roll motor is controllable in a wireless or wired fashion. When a signal is transmitted to the roll motor to energize the roll motor to rotate the rolls, a used region of the polishing pad can automatically be replaced with a new region thereof.

In a preferred aspect of the present invention, the polishing pad comprises one of a polyurethane foam pad, a suede type pad, and a fixed abrasive pad comprising abrasive particles embedded therein.

In a preferred aspect of the present invention, the polishing apparatus further comprises a sensor for detecting surface roughness of the polishing pad.

In a preferred aspect of the present invention, the polishing apparatus further comprises a sensor for detecting surface for detecting surface roughness of the polishing pad, and the roll motor is energized on the basis of a detection signal of the sensor.

In a preferred aspect of the present invention, the polishing pad comprises a plurality of sub-pads which are divided along a take-up direction of the polishing pad.

According to a second aspect of the present invention, there is provided a polishing apparatus comprising: a polishing table for making predetermined motion; a top ring vertically movably disposed above the polishing table for removably holding a workpiece to be polished; a polishing pad supply device for holding an elongate polishing pad and supplying the polishing pad therefrom; and a polishing pad holding device for holding the polishing pad supplied from the polishing pad supply device and placing the polishing pad such that the polishing pad makes predetermined motion integrally with the polishing table.

According to the second aspect of the present invention, the polishing pad is supplied from the polishing pad supply device, and the supplied polishing pad is held by the polishing pad holding device and placed in an elongate state on the polishing table. Thus, even if the polishing table is in motion, a used region of the polishing pad can thus automatically be replaced with a new region of the polishing pad.

In a preferred aspect of the present invention, the polishing pad supply device comprises a supply roll onto which the elongate polishing pad is wound.

In a preferred aspect of the present invention, the polishing pad holding device comprises a take-up roll onto which the elongate polishing pad is to be wound.

In a preferred aspect of the present invention, the polishing table has an attraction section for attracting and holding the polishing pad to the polishing table.

In a preferred aspect of the present invention, the polishing apparatus further comprises a roll motor connected to the take-up roll, wherein the roll motor is controllable in a wireless or wired fashion.

In a preferred aspect of the present invention, the predetermined motion of the polishing table is one of rotary motion, circulatory motion, and linear reciprocating motion.

According to a third aspect of the present invention, there is provided a polishing apparatus comprising: a polishing table for making predetermined motion; a top ring vertically movably disposed above the polishing table for removably holding a workpiece to be polished; a polishing pad supply device for holding an elongate polishing pad and supplying the polishing pad therefrom; a polishing pad holding device for holding the polishing pad supplied from the polishing pad supply device and placing the polishing pad such that the polishing pad makes predetermined motion integrally with the polishing table; and a sensor for detecting surface roughness of the polishing pad.

According to a fourth aspect of the present invention, there is provided a polishing apparatus comprising: a polishing table for making predetermined motion; a top ring vertically movably disposed above the polishing table for removably holding a workpiece to be polished; a polishing pad supply device for holding an elongate polishing pad and supplying the polishing pad therefrom; a polishing pad holding device for holding the polishing pad supplied from the polishing pad supply device and placing the polishing pad such that the polishing pad makes predetermined motion integrally with the polishing table; and a brush for removing from the polishing pad ground-off material produced during a polishing process.

According to a fifth aspect of the present invention, there is provided a polishing apparatus comprising: a polishing table for making predetermined motion; a top ring vertically movably disposed above the polishing table for removably holding a workpiece to be polished; a polishing pad supply device for holding an elongate polishing pad and supplying the polishing pad therefrom; a polishing pad holding device for holding the polishing pad supplied from the polishing pad supply device and placing the polishing pad such that the polishing pad makes predetermined motion integrally with the polishing table; and an atomizer for spraying a gas-liquid mixture onto the polishing pad.

According to a sixth aspect of the present invention, there is provided a polishing apparatus comprising: a polishing table for making predetermined motion; a top ring vertically movably disposed above the polishing table for removably holding a workpiece to be polished; a polishing pad supply device for holding an elongate polishing pad and supplying the polishing pad therefrom; a polishing pad holding device for holding the polishing pad supplied from the polishing pad supply device and placing the polishing pad such that the polishing pad makes predetermined motion integrally with the polishing table; and an eddy-current sensor for monitoring thickness of a film of the workpiece.

According to a seventh aspect of the present invention, there is provided a polishing apparatus comprising:

a first polishing table which mounts a polishing pad on a surface of the first polishing table, wherein the polishing pad being is held by at least two rolls disposed around the first polishing table; and a second polishing table which mounts a polishing pad on a surface of the second polishing table, wherein the polishing pad is held by at least two rolls disposed around the second polishing table.

According to an eighth aspect of the present invention, there is provided a polishing apparatus comprising:

a first polishing table which mounts a polishing pad on a surface of the first polishing table, wherein the polishing pad is held by at least two rolls disposed around the first polishing table; and a second polishing table which mounts a polishing pad on a surface of the second polishing table, wherein the polishing pad is held by at least two rolls disposed around the second polishing table, wherein respective shafts of the rolls are substantially parallel to a polishing surface of the polishing pad.

The above and other objects, features and advantages of the present invention will become apparent from the following description when taken in conjunction with the accompanying drawings which illustrate a preferred embodiment of the present invention.

DETAILED DESCRIPTION OF THE PREFERRED EMBODIMENTS

A polishing apparatus according to embodiments of the present invention will be described with reference to drawings.

Figure 1:
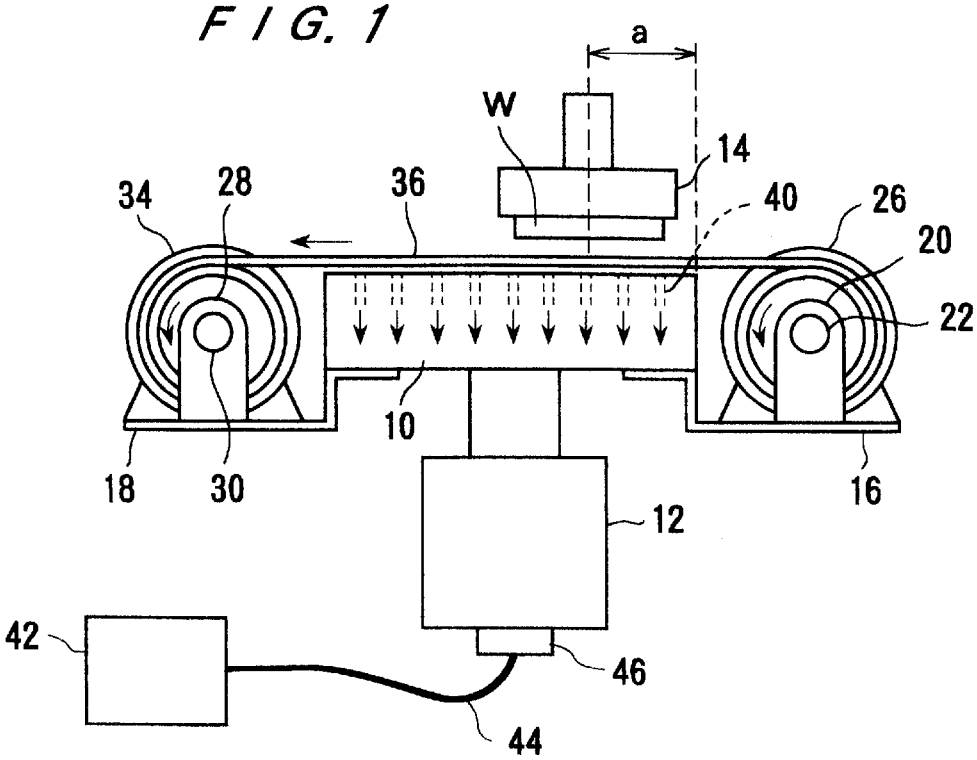
FIG. 1 is a front elevational view showing an essential part of a polishing apparatus according to a first embodiment of the present invention.
Figure 2:
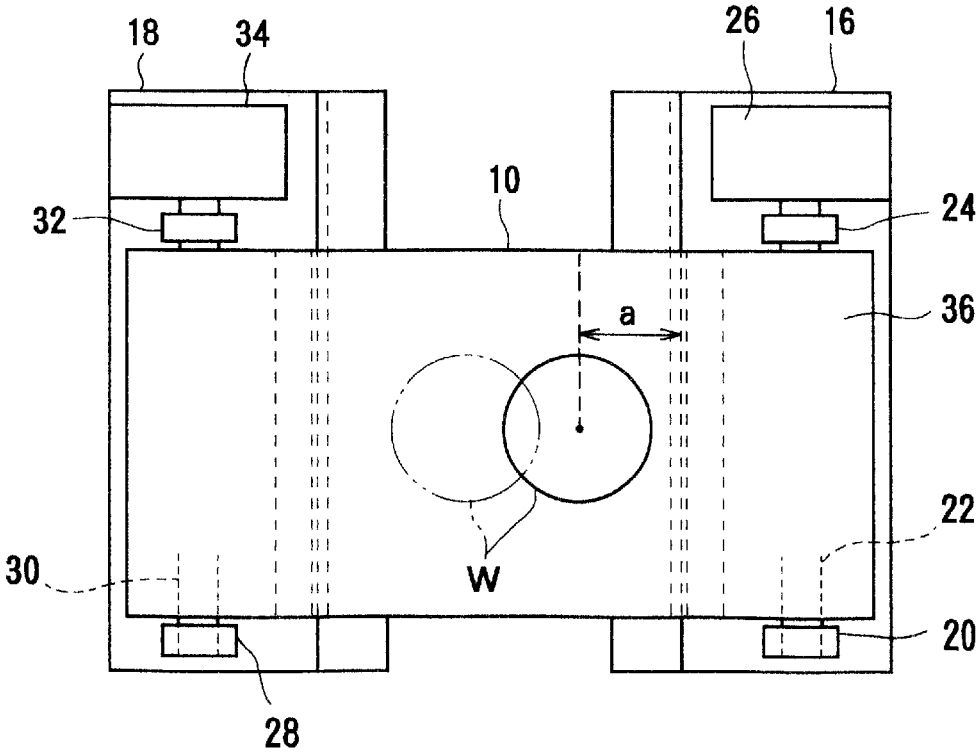
FIG. 2 is a plan view showing an essential part of the polishing apparatus according to the first embodiment of the present invention.

FIGS. 1 and 2 show a polishing apparatus according to a first embodiment of the present invention. As shown in FIGS. 1 and 2, a polishing apparatus according to the present invention comprises a rectangular planar polishing table 10, a motor 12 for rotating the polishing table 10, and a top ring 14 vertically movably disposed above the polishing table 10 for removably holding a substrate W such as a semiconductor wafer with its surface, to be polished, facing the polishing table 10.

Support plates 16, 18 are attached to lower surfaces of opposite sides of the polishing table 10 and extend horizontally away from each other from the opposite sides of the polishing table 10. The support plate 16 supports a bearing 20 on its upper surface. An elongate supply roll 22 has an end rotatably supported by the bearing 20, and an opposite end connected by a coupling 24 to a supply roll motor 26 that is supported on an upper surface of the support plate 16. When the supply roll motor 26 is energized, the supply roll 22 is rotated about its own axis. The other support plate 18 supports a bearing 28 on its upper surface. An elongate take-up roll 30 has an end rotatably supported by the bearing 28 and an opposite end connected by a coupling 32 to a take-up roll motor 34 that is supported on an upper surface of the support plate 18. When the take-up roll motor 34 is energized, the take-up roll 30 is rotated about its own axis.

An elongate polishing pad 36 is wound onto the supply roll 22, extends along an upper surface of the polishing table 10, and has a free end removably gripped by the take-up roll 30. When the supply roll motor 26 and the take-up roll motor 34 are energized, the supply roll 22 and the take-up roll 30 are synchronously rotated about their own axes in one direction to cause the polishing pad 36 to travel from the supply roll 22 along the upper surface of the polishing table 10 toward the take-up roll 30 onto which the polishing pad 36 is wound. Tension of the polishing pad 36 between the supply roll 22 and the take-up roll 30 can be adjusted by regulating rotational speeds of the supply roll 22 and the take-up roll 30. The polishing pad 36 can be returned from the take-up roll 30 toward the supply roll 22 when the supply roll 22 and the take-up roll 30 are reversed.

The polishing table 10 has an attraction section 40 for attracting the polishing pad 36 under vacuum to the upper surface of the polishing table 10. The attraction section 40 comprises a plurality of vacuum holes which are formed in the polishing table 10, and are open at the upper surface of the polishing table 10 and connected to a vacuum source such as a vacuum pump. A rotary joint 46 which connects a cable 44 extending from a controller 42, and cables extending respectively from the supply roll motor 26 and the take-up roll motor 34, is attached to the motor 12. The controller 42 controls the supply roll motor 26 and the take-up roll motor 34, respectively, through the cable 44 and the cables extending from the motors. However, the controller 42 may be arranged to control the supply roll motor 26 and the take-up roll motor 34 in a wireless fashion.

The polishing apparatus shown in FIGS. 1 and 2 operates as follows: While the polishing table 10 and the top ring 14 are being rotated independently about their own axes, the substrate W is pressed against the polishing pad 36 under a constant pressure by the top ring 14, and a polishing liquid is supplied from a nozzle (not shown) to the polishing pad 36, thereby polishing the surface of the substrate W to a flat mirror finish. At this time, the supply roll 22 and the take-up roll 30 also rotate about the axis of the polishing table 10 in unison with the polishing table 10. The polishing pad 36 is attracted to and held by the upper surface of the polishing table 36 under vacuum developed in the vacuum holes of the attraction section 40. Therefore, the polishing pad 36 is prevented from being displaced with respect to the polishing table while the substrate W is being polished thereby.

For polishing an oxide film on the substrate W, for example, the polishing liquid comprises a silica slurry such as SS-25 (manufactured by Cabbot), a $CeO_2$ slurry, or the like. For polishing a tungsten film on the substrate W, for example, the polishing liquid comprises a silica slurry such as W2000 (manufactured by Cabbot) containing $H_2O_2$ as an oxidizing agent, an alumina-base slurry of iron nitrate, or the like. For polishing a copper film on the substrate W, for example, the polishing liquid comprises a slurry containing an oxidizing agent, such as $H_2O_2$ for turning the copper film into a copper oxide film, a slurry for polishing a barrier layer, or the like. In order to remove particles or defects from the substrate being polished, surfactant or alkali solution as a polishing liquid may be supplied halfway through a polishing operation for conducting a finish polishing.

The polishing pad 36 is made of polyurethane foam such as IC1000 or a suede-like material such as Polytex. In order to increase resiliency of the polishing pad 36, the polishing pad 36 may be lined with a layer of nonwoven cloth or sponge, or a layer of nonwoven cloth or sponge may be attached to the upper surface of the polishing table 10.

The polishing pad 36 may comprise a fixed abrasive pad comprising particles of $CeO_2$, silica, alumina, SiC, or diamond embedded in a binder, so that the polishing pad 36 can polish the substrate W while not a polishing liquid containing abrasive particles, but rather a polishing liquid containing no abrasive particles, is being supplied thereto. An ammeter, a vibrometer, or an optical sensor may be incorporated into the polishing table and/or the top ring 14 for measuring a state of the substrate W while the substrate W is being polished.

When a region of the polishing pad 36 which has been used is worn to such an extent that its polishing capability can no longer be restored by a dresser, the controller 42 sends a signal to energize the supply roll motor 26 and the take-up roll motor 34 to rotate the supply roll 22 and the take-up roll 30, respectively, in synchronism with each other in one direction. Thus, the polishing pad 36 travels from the supply roll 22 toward the take-up roll 30 along the upper surface of the polishing table 10. After the polishing pad 36 has traveled a predetermined distance, which is long enough to displace the worn region of the polishing pad 36 off the upper surface of the polishing table 10, the controller 42 de-energizes the supply roll motor 26 and the take-up roll motor 34 to stop the supply roll 22 and the take-up roll 30, thus positioning a new region of the polishing pad 36 over the upper surface of the polishing table 10.

Even when the polishing table 10 is in rotation, the worn region of the polishing pad 36 can be automatically replaced with a new region thereof by transporting the polishing pad 36 from the supply roll 22 toward the take-up roll 30 over the upper surface of the polishing table 10 by the predetermined distance corresponding to a length of the polishing table 10, i.e. one pad and then stopping the polishing pad 36. Alternatively, the polishing pad 36 may be wound onto the take-up roll 30 by a distance "a", shown in FIGS. 1 and 2, corresponding to a distance from an end of the polishing table 10 to a center of the substrate W located at a polishing position. Thus, a new polishing pad and a used polishing pad are simultaneously presented, with the new polishing pad and the used polishing pad having different regions in a radial direction of the substrate W for thereby imparting a polishing action equally to an entire surface of the substrate W.

The polishing pad 36 and the supply roll 22 may be 25 integrally combined into a cartridge, so that they can be quickly installed and removed between the bearing 20 and the coupling 24. The supply roll motor 26 may be eliminated, and the polishing pad 36 may be supplied from the supply roll 22 toward the take-up roll 30 only by the take-up roll motor 34. The polishing pad table 10 may be of a circular shape.

Figure 3:
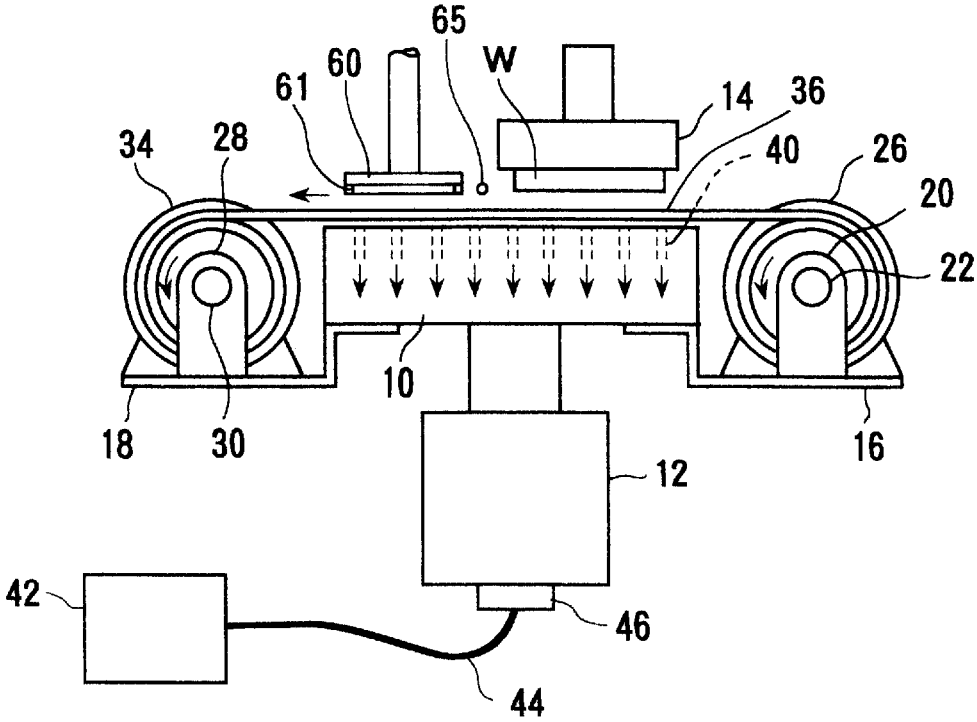
FIG. 3 is a front elevational view of the polishing apparatus shown in FIGS. 1 and 2, and additionally incorporating a dressing apparatus.
Figure 4:
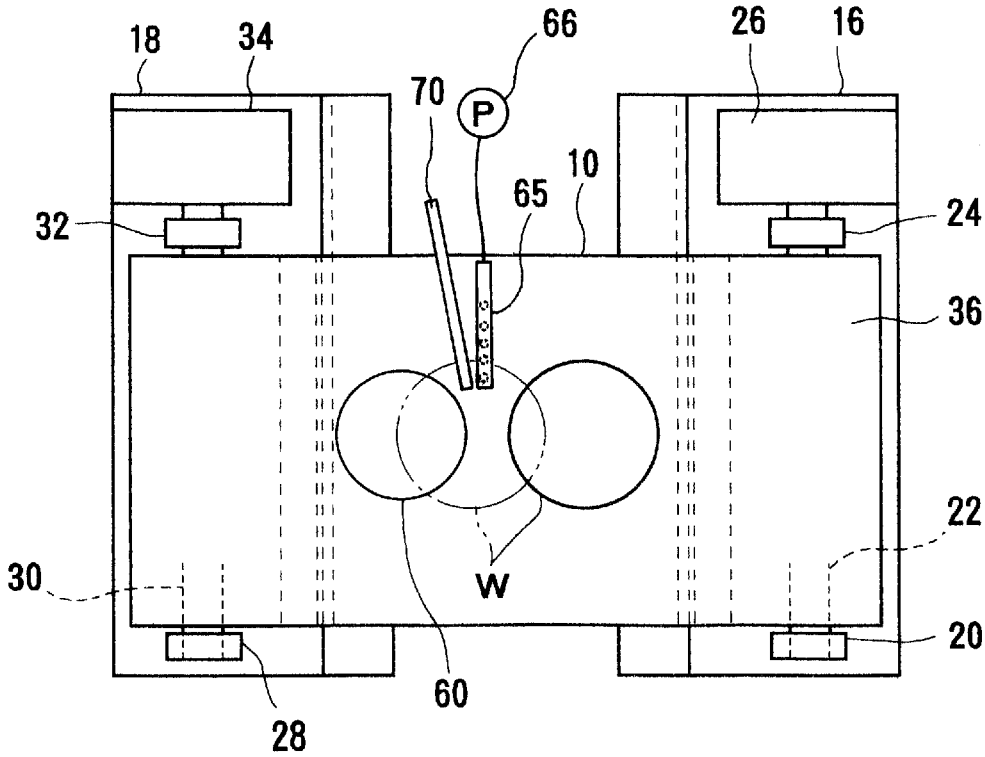
FIG. 4 is a plan view of the polishing apparatus shown in FIGS. 1 and 2, and additionally incorporating the dressing apparatus of FIG. 3.

FIGS. 3 and 4 show the polishing apparatus shown in FIGS. 1 and 2 to which a dressing apparatus and the like are added. Specifically, the polishing apparatus is provided with a diamond dresser 60 and a water jet nozzle 65. The polishing liquid supply nozzle 70 denotes a polishing liquid supply nozzle for supplying a polishing liquid onto a central area of the polishing table 10. The diamond dresser 60 is angularly movable in a horizontal plane between a dressing position over the polishing table 10 and a standby position off the polishing table 10. The diamond dresser 60 has an electrodeposited diamond ring 61 which comprises fine grains of diamond electrodeposited on a lower surface of the ring. Specifically, the electrodeposoted diamond ring 61 is produced by attaching fine grains of diamond to its lower surface and then plating its lower surface with nickel for thereby fixing the fine grains of diamond with a plated nickel layer. The dresser 60 may be replaced with an SiC dresser having a ring of sectors made of silicon carbide. The SiC dresser has on surfaces of its sectors a number of pyramidal projections each having a height of about several tens of $\mu$m.

On the other hand, the water jet nozzle 65 extends to a central area of the polishing pad 36 in a width direction of the polishing pad 36, and has a plurality of openings disposed on its lower surface at certain intervals for ejecting pure water jets therefrom. The water jet nozzle 65 is connected to a pump 66, and pressure of the water jets ejected from the openings can be maintained in a range of 490 to 2940 kPa (5 to 30 kg/cm$^2$) by controlling rotational speed of the pump 66.

With the above arrangement, the substrate W is polished by supplying the polishing liquid containing abrasive particles from the polishing liquid supply nozzle 70 onto the polishing pad 36, and then finish-polished by stopping supply of the polishing liquid from the polishing liquid supply nozzle 70 and supplying ultrapure water from the water jet nozzle 65 onto the polishing pad 36. When the polishing pad 36 starts to be used, it is first dressed by the diamond dresser 60 for initial conditioning. Thereafter, the substrate W is polished using the dressed polishing pad 36. Between polishing processes, the polishing pad 36 is dressed by the water jet nozzle 65 with water jets ejected therefrom.

Alternatively, when the polishing pad 36 starts to be used, it is first dressed by the diamond dresser 60 for initial conditioning. Thereafter, the substrate W is polished using the dressed polishing pad 36. Between polishing processes, the polishing pad 36 is dressed in two steps, i.e., first by the diamond dresser 60 and then by the water jet nozzle 65 with water jets ejected therefrom.

According to the polishing apparatus of the present invention, finish-polishing can be conducted by supplying ultrapure water as a polishing liquid to the polishing pad 36 from the water jet nozzle 65. Further, after initial conditioning of the polishing pad 36 by the diamond dresser 60, a polishing process of the substrate W is carried out, and after completing the polishing process, dressing of the polishing pad 36 with water jets is carried out by the water jet nozzle 65. Thereafter, a polishing process is carried out again. Further, between polishing processes, dressing of the polishing pad 36 by the diamond and water jets may be combined.

In the illustrated embodiment, the diamond dresser 60 is a contact-type dresser. However, the diamond dresser may be replaced with a brush dresser.

Figure 5:
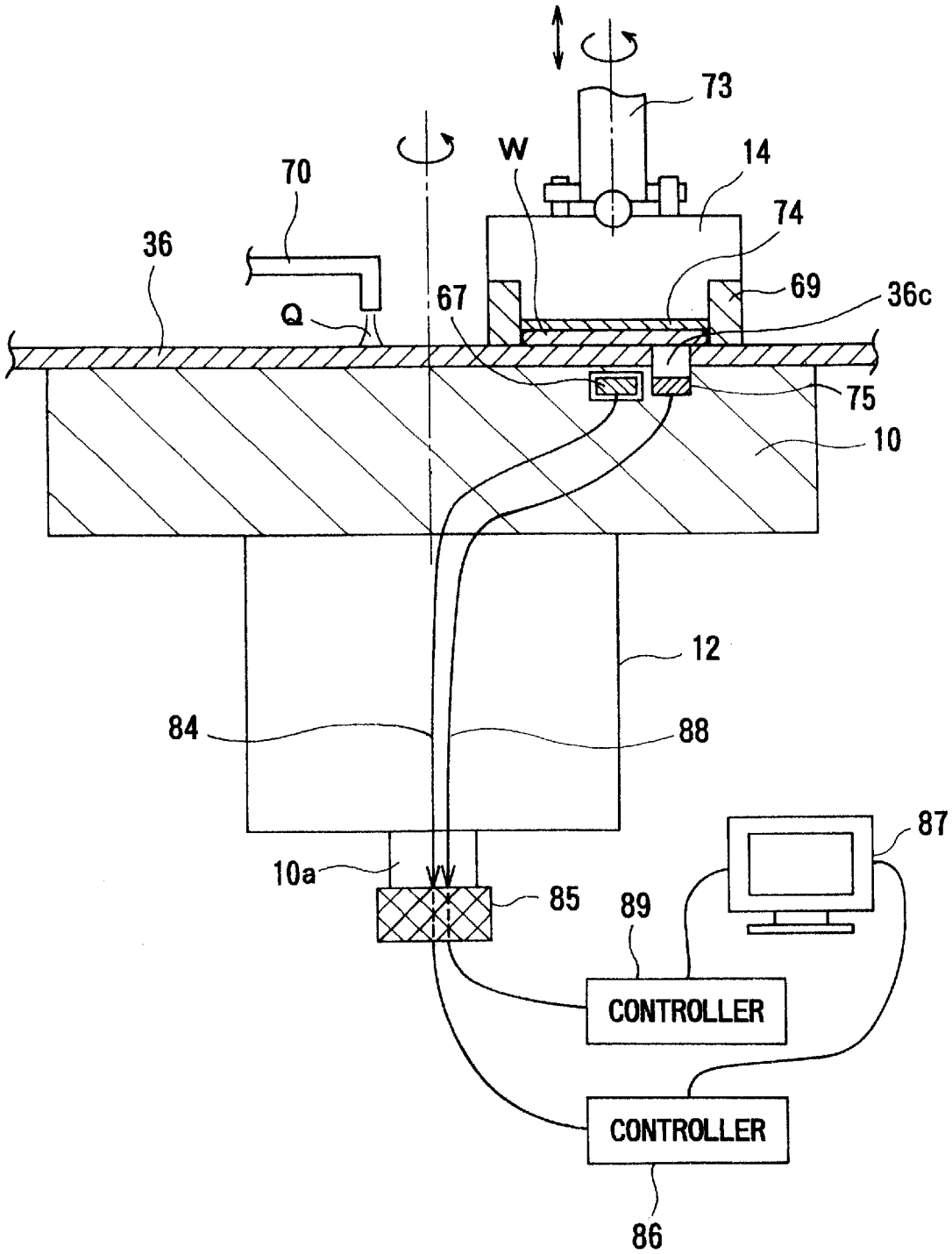
FIG. 5 is a cross-sectional view showing a polishing pad, polishing table and top ring.

Next, sensors provided in the polishing table for monitoring a state of the substrate being polished will be described with reference to FIGS. 5 through 7. FIG. 5 shows the polishing table and top ring in cross-section. In FIG. 5, the polishing pad 36 is attached to the polishing table 10 under vacuum.

As shown in FIG. 5, an eddy-current sensor 67 is mounted in the polishing table 10, and is electrically connected to a controller 86 by a wire 84 extending through the polishing table 10, a table support shaft 10*a*, and a rotary connector or slip ring 85 mounted on a lower end of the table support shaft 10*a*. The controller 86 is connected to a display unit 87.

An optical sensor 75 is mounted in the polishing table 10 adjacent to the eddy-current sensor 67. The optical sensor 75 comprises a light-emitting element and a light-detecting element. The light-emitting element applies light to the surface, being polished, of the substrate W, and the light-detecting element detects reflected light from the surface, being polished, of the substrate W. The polishing pad 36 has an opening 36*c* at a position corresponding to the optical sensor 75. The optical sensor 75 is electrically connected to a controller 89 by a wire 88 extending through the polishing table 10, the table support shaft 10*a*, and the rotary connector 85 mounted on the lower end of the table support shaft 10*a*. The controller 89 is connected to the display unit 87.

The top ring 14 is coupled to a motor (not shown) and connected to a lifting/lowering cylinder (not shown). Therefore, the top ring 14 is vertically movable and rotatable about its own axis, as indicated by arrows, and can press the substrate W against the polishing pad 36 under a desired pressure. The top ring 14 is connected to the lower end of a vertical top ring drive shaft 73, and supports on its lower surface an elastic pad 74 of polyurethane or the like. A cylindrical retainer ring 69 is provided around an outer circumferential edge of the top ring 14 for preventing the substrate W from being dislodged from the top ring 14 while the substrate W is being polished.

Figure 6:
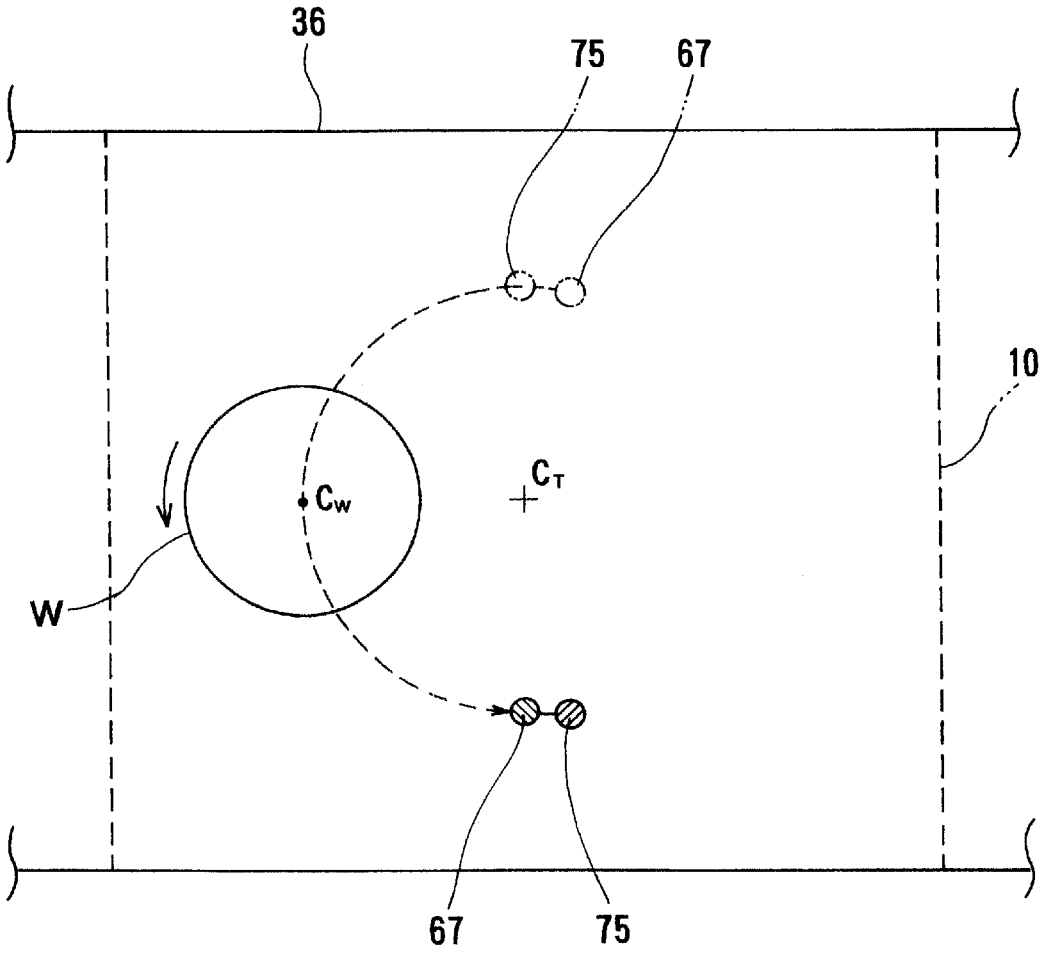
FIG. 6 is a plan view showing a polishing pad and polishing table in which sensors are embedded.

FIG. 6 is a plan view showing the polishing pad 36 and the polishing table 10 in which the sensors are mounted. As shown in FIG. 6, the eddy-current sensor 67 and the optical sensor 75 are positioned so as to pass through a center $C_W$ of the substrate W held by the top ring 14 while the substrate W is being polished, when the polishing table 10 rotates about its own axis $C_T$. While the eddy-current sensor 67 and the optical sensor 75 pass along an arcuate path beneath the substrate W, the eddy-current sensor 67 and the optical sensor 75 continuously detect a thickness of a film such as a copper layer on the substrate W. In order to shorten an interval between detecting intervals, one or more eddy-current sensors 67 and one or more optical sensors 75 may be added as indicated by imaginary lines in FIG. 6, so that at least two sets of sensors are provided in the polishing table 10.

The polishing apparatus shown in FIG. 6 operates as follows: The substrate W is held on a lower surface of the top ring 14, and pressed by the lifting/lowering cylinder against the polishing pad 36 on the polishing table 10 which is rotating. The polishing liquid supply nozzle 70 supplies polishing liquid Q to the polishing pad 36 on the polishing table 10, and the supplied polishing liquid Q is retained on the polishing pad 36. The substrate W is polished in the presence of the polishing liquid Q between a lower surface of the substrate W and the polishing pad 36. While the substrate W is being thus polished, the eddy-current sensor 67 passes directly beneath the surface, being polished, of the substrate W each time the polishing table 10 makes one revolution. Since the eddy-current sensor 67 is positioned on an arcuate path extending through the center $C_W$ of the substrate W, the eddy-current sensor 67 is capable of continuously detecting a thickness of a film on the substrate W as the eddy-current sensor 67 moves along the arcuate path beneath the substrate W.

Principles of detecting a thickness of a film of copper, aluminum or the like on the substrate W with the eddy-current sensor 67 will be described below.

The eddy-current sensor has a coil which is supplied with a high-frequency current. When the high-frequency current is supplied to the coil of the eddy-current sensor, an eddy current is generated in film on the substrate W. Since the generated eddy current varies depending on a thickness of the film, combined impedance of the eddy-current sensor and the film, such as a copper layer, is monitored to detect the thickness of the film. Specifically, combined impedance Z of the eddy-current sensor and the copper layer is represented by inductive and capacitive elements L, C of the eddy-current sensor, and resistive element R of the copper layer which is connected in parallel to the inductive and capacitive elements L, C. When the resistive element R in the equation shown below varies, the combined impedance Z also varies. At this time, resonance frequency also varies, and a rate of change of the resonance frequency is monitored to determine an end point of a CMP process.

$$Z = \frac{jwL}{(1 - \omega^2 LC) + \frac{jwL}{R}}$$

where Z is combined impedance, j is square root of −1 (imaginary number), L is inductance, f is resonance frequency, C is electrostatic capacitance, R is resistance of the copper layer, and $\omega = 2\pi f$.

Figure 7A:
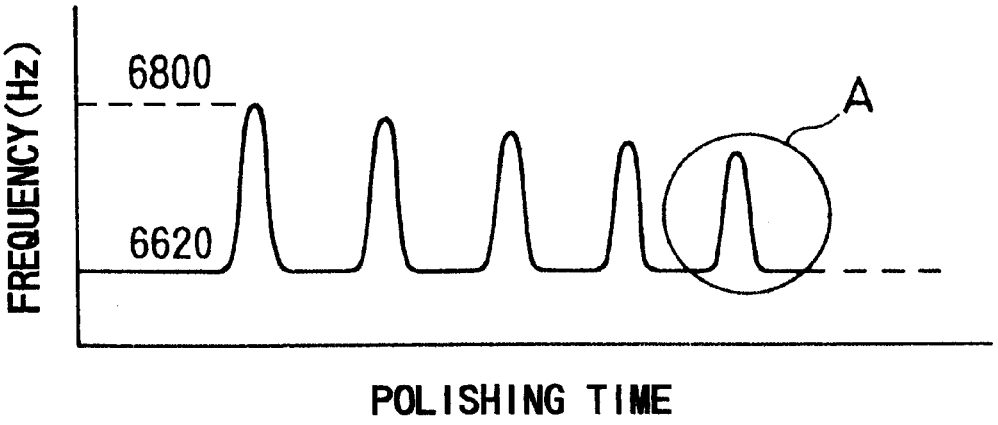
FIGS. 7A and 7B are graphs showing changes in resonance frequency of a detected signal that is produced by an eddy-current sensor and processed by a controller while a substrate is being polished.
Figure 7B:
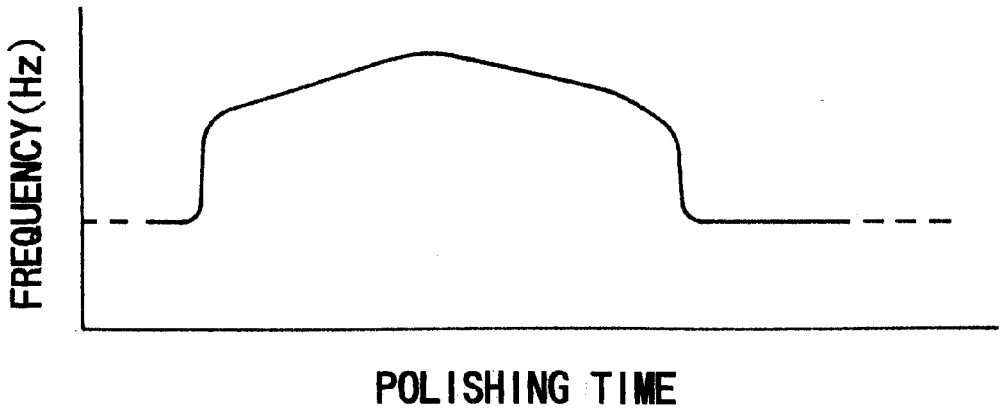

FIGS. 7A and 7B are graphs showing changes in resonance frequency of a detected signal that is produced by the eddy-current sensor 67 and processed by the controller 86 while the substrate W is being polished. In FIGS. 7A and 7B, the horizontal axis represents polishing time, and the vertical axis represents the resonance frequency (Hz). FIG. 7A shows changes in the resonance frequency when the eddy-current sensor 67 passes a plurality of times directly below the substrate W, and FIG. 7B shows, at an enlarged scale, an encircled portion A in FIG. 7A. Results shown in FIGS. 7A and 7B are obtained when the film on the substrate W is a copper layer.

As shown in FIG. 7A, as polishing of the substrate W progresses, a value produced by processing a detected signal from the eddy-current sensor 67 is progressively reduced. This processing of the detected signal is performed by the controller 86. Specifically, as thickness of the copper layer decreases, resonance frequency obtained by processing the detected signal from the eddy-current sensor 67 is progressively reduced. In FIG. 7A, the resonance frequency decreases from an initial value of 6800 Hz. Therefore, if a value of the resonance frequency, at a time when the copper layer is removed, except for copper in interconnection grooves, has been examined, then an end point of a CMP process can be detected by monitoring the value of the resonance frequency. In FIG. 7A, the value of the resonance frequency at the time when the copper layer is removed, except for copper in the interconnection grooves, is 6620 Hz. If a certain frequency before reaching the end point of the CMP process is established as a threshold, then it is possible to polish the substrate W under a first polishing condition, then polish the substrate W under a second polishing condition after the threshold is reached, and finish the CMP process when the end point thereof is reached by removing the copper layer and a barrier layer completely.

Next, the principles of detecting the thickness of the copper layer on the substrate W by the optical sensor 75 will be briefly described.

During polishing, every time the polishing table 10 makes one revolution, the optical sensor 75 passes along an arcuate path beneath the substrate W. Thus, light emitted from the light-emitting element in the optical sensor 75 passes through the hole of the polishing table 10 and the opening 36*c* of the polishing pad 36 and is incident on a surface, being polished, of the substrate W, and light reflected from the surface of the substrate W is received by the light-detecting element in the optical sensor 75. The light received by the light-detecting element is processed by the controller 89 to measure a thickness of a top layer on the substrate W.

Principles of detecting a thickness of a film by the optical sensor utilizes interference of light caused by the top layer and a medium adjacent to the top layer. When light is applied to a thin film on a substrate, a part of the light is reflected from a surface of the thin film while a remaining part of the light is transmitted through the thin film. A part of the transmitted light is then reflected from a surface of an underlayer or the substrate, while a remaining part of the transmitted light is transmitted through the underlayer or the substrate. In this case, when the underlayer is made of a metal, light is absorbed in the underlayer. A phase difference between light reflected from the surface of the thin film and light reflected from the surface of the underlayer or the substrate creates the interference. When phases of these two lights are identical to each other, light intensity is increased, while when the phases of the two lights are opposite to each other, the light intensity is decreased. That is, reflection intensity varies with a wavelength of incident light, film thickness, and a refractive index of the film. Light reflected from the substrate is separated by a diffraction grating or the like, and a profile depicted by plotting intensity of reflected light for each wavelength is analyzed to measure the thickness of the film on the substrate.

By the polishing apparatus incorporating two kinds of sensors for measuring film thickness, until a thickness of the film, such as a copper layer, is reduced to a certain smaller value, thickness of the film is monitored by the controller 86 which processes a signal from the eddy-current sensor 67. When thickness of the film reaches the certain smaller value and begins to be detected by the optional sensor 75, thickness of the thin film is monitored by the controller 89 which processes a signal from the optical sensor 75. Therefore, by using the optical sensor 75 which is of a higher sensitivity with regard to thickness of a copper layer (film), it is possible to accurately detect when a copper layer is removed, except for copper in the interconnection grooves, thereby determining an end point of a CMP process.

Alternatively, both the eddy-current sensor 67 and the optical sensor 75 can be used until an end point of a CMP process is reached. Specifically, the controllers 86 and 89 process respective signals from the eddy-current sensor 67 and the optical sensor 75 to detect when a copper layer is removed, except for copper in interconnection grooves, thereby determining an end of the CMP process. In the above embodiments, the film on the substrate W is made of copper. However, the film to be measured may comprise an insulating layer such as $SiO_2$.

In the illustrated embodiments, the polishing table 10 is rotated about its own axis. However, principles of the present invention are also applicable to a polishing apparatus in which a polishing table makes circulatory motion, i.e. scroll motion.

Figure 8:
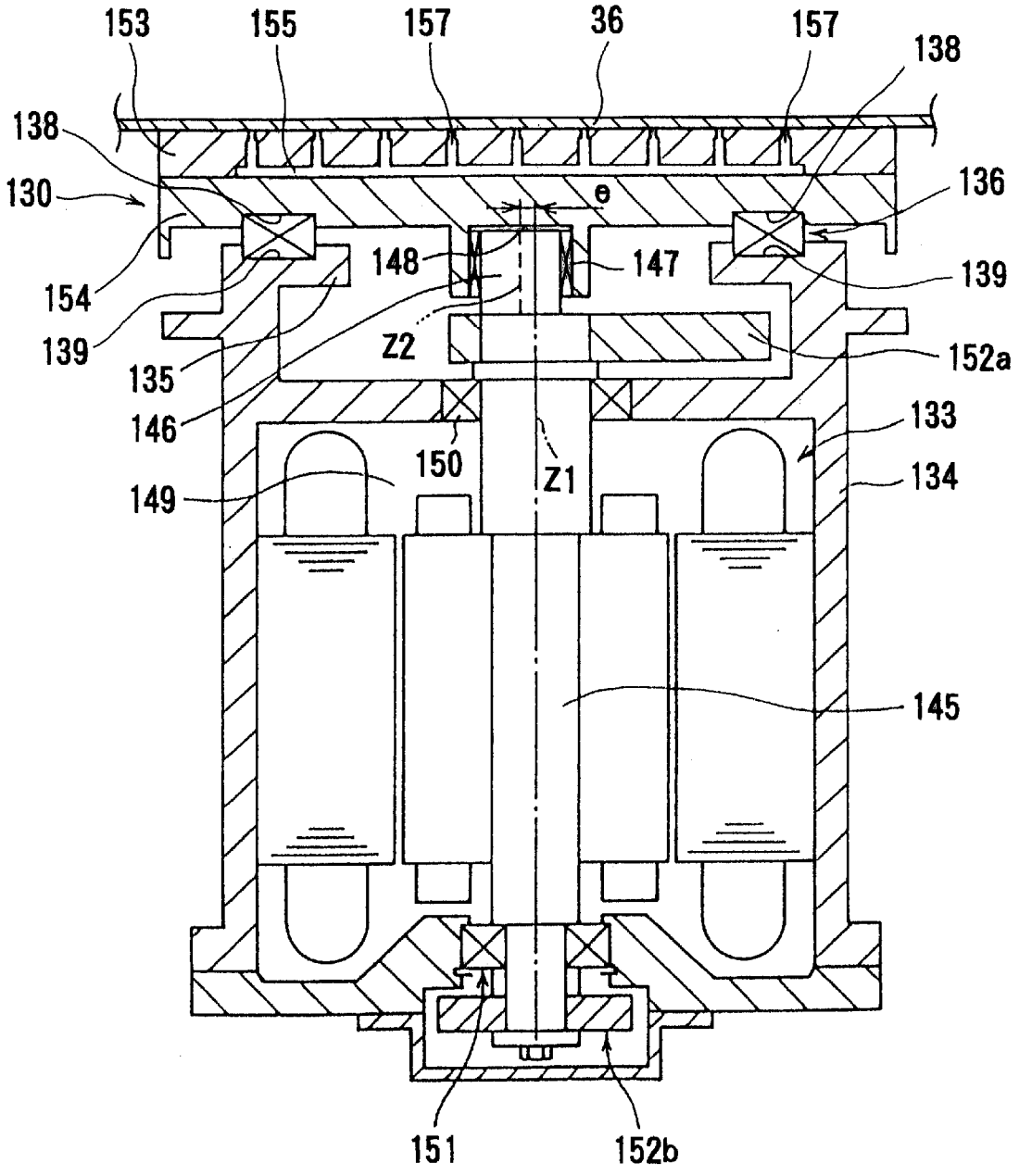
FIG. 8 is a cross-sectional view showing a polishing table and a motor section.
Figure 9A:
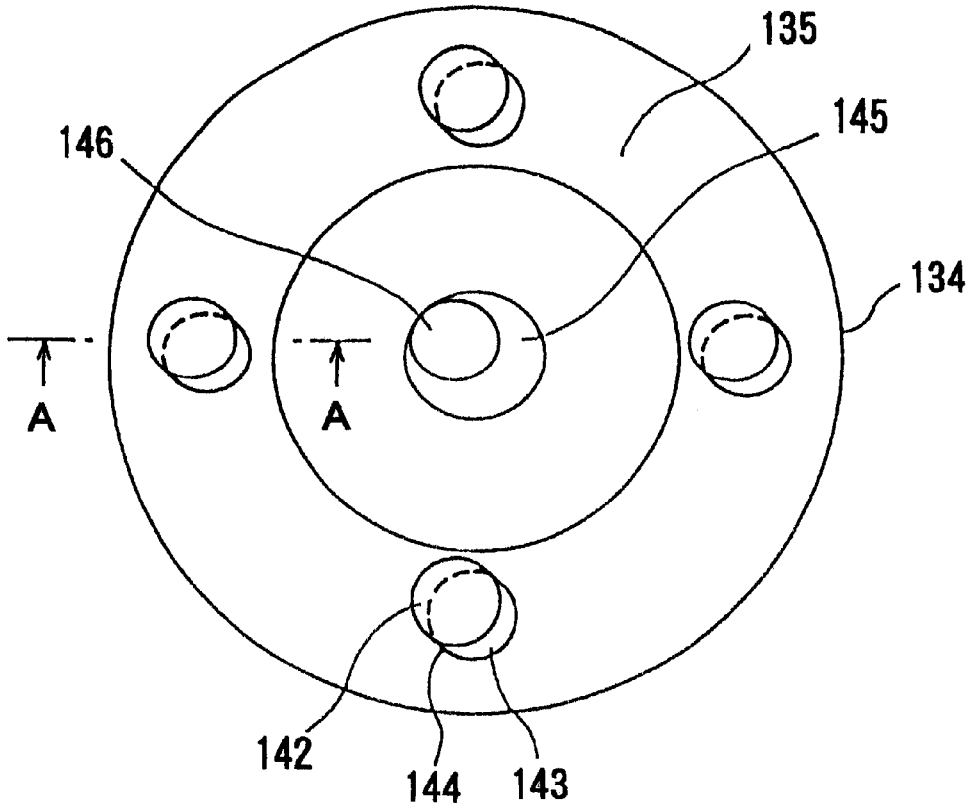
FIG. 9A is a plan view showing a section for supporting the polishing table of FIG. 8.
Figure 9B:
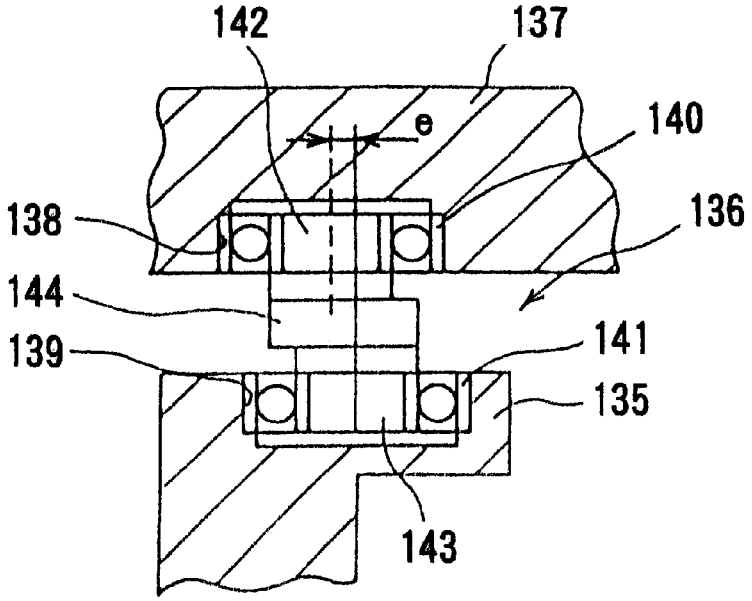
FIG. 9B is a cross-sectional view taken along line A—A of FIG. 9A.

Next, a polishing table which makes scroll motion will be described with reference to FIGS. 8, 9A and 9B. FIG. 8 is a cross-sectional view showing a polishing table and a motor section, FIG. 9A is a plan view showing a section for supporting the polishing table, and FIG. 9B is a cross-sectional view taken along line A—A of FIG. 9A. In FIG. 8, polishing pad 36 is held by a polishing table 130 under vacuum.

As shown in FIG. 8, circular polishing table 130 is supported by a cylindrical casing 134 which houses a drive motor 133 therein. Specifically, an annular support plate 135 extending radially inwardly is provided at an upper part of the cylindrical casing 134, three or more support sections 136 are formed in a circumferential direction on the annular support plate 135, and the circular polishing table 130 is supported by these support sections 136. The support sections 136 and the circular polishing table 130 have a plurality of recesses 138, 139, respectively, in upper and lower surfaces thereof at positions facing each other. The recesses are arranged at circumferentially equal intervals, and bearings 140, 141 are fitted into the recesses 138, 139, respectively (see FIG. 9B). Connecting members 144 which have upper and lower shafts 142, 143 of each connecting member 144 are fitted into the bearings 140, 141, respectively.

An axis of the upper shaft 142 of a connecting member 144 is displaced from an axis of the lower shaft 143 of the connecting member by an eccentric distance "e" as shown in FIG. 9B, thereby allowing the polishing table 130 to make circulative translation motion (scroll motion) along a circle having a radius "e".

As shown in FIG. 8, a recess 148 is formed in a central area of a bottom surface of the polishing table 130 for accommodating a drive shaft 146 of a main shaft 145 through a bearing 147 fitted in the recess 148. An axis of the drive shaft 146 is displaced from an axis of the main shaft 145 by an eccentric distance "e" as well. The drive motor 133 is housed in a motor chamber 149 formed in the casing 134, and the main shaft 145 of the drive motor 133 is supported by upper and lower bearings 150, 151.

The polishing table 130 has a diameter slightly larger than the sum of twice offset length "e" and a diameter of a substrate to be polished, and is constructed by joining two plate-like members 153, 154. A space 155 is defined between the two plate-like members 153, 154, and communicates with a vacuum source such as a vacuum pump and a plurality of vacuum holes 157 which are open at an upper surface of the polishing table 130. Thus, when the space 155 communicates with the vacuum source, the polishing pad 36 is attracted to the polishing table 130 under vacuum through the vacuum holes 157. A top ring (not shown) as a pressing device has the same structure as those shown in FIGS. 1 and 5, except that this top ring rotates at a slower rotational speed.

With the above structure, while the polishing table 130 makes scroll motion and top ring 14 (see FIGS. 1 and 5) is rotated about its own axis, substrate W is pressed against the polishing pad 36 under a constant pressure by the top ring 14 while a polishing liquid is supplied from a nozzle (not shown) onto the polishing pad 36, thereby polishing a surface of the substrate W to a flat mirror finish. At this time, the polishing pad 36 is attracted to and held by the upper surface of the polishing table 130 under vacuum, and hence the polishing pad 36 is prevented from being displaced with respect to the polishing table 130 during polishing. Action of minute circulative transnational motion (scroll motion) of radius "e" between the substrate W and a polishing surface of the polishing pad 36 produces a uniform polishing over an entire surface of the substrate W. If a positional relationship between a surface, to be polished, of the substrate W and the polishing surface of the polishing pad 36 is the same, then a polished surface of the substrate is adversely influenced by local differences in surface conditions of the polishing pad 36. In order to avoid such adverse influence, the top ring 14 is slowly rotated about its own axis to prevent the surface of the substrate W from being polished at the same position on the polishing pad 36.

Because the polishing table 130 shown in FIGS. 8, 9A and 9B is a scroll motion type, a size of the polishing table 130 needs only to be larger than a size of a substrate, to be polished, by the eccentric distance "e". Therefore, installation space required for installing the polishing table is reduced significantly in comparison to a rotating-type polishing table. Further, since the polishing table 130 makes a scrolling motion, the polishing table 130 can be supported at a plurality of positions near a peripheral portion thereof as shown in FIG. 8, and hence a substrate can be polished to a higher degree of flatness in comparison with a rotation-type polishing table which rotates at a high speed.

The polishing table shown in FIGS. 8, 9A and 9B may supply a polishing liquid onto the polishing surface of the polishing pad 36 through the polishing table. In this case, the space 155 is connected to a polishing liquid supply source, and through-holes are formed in the polishing pad 36 at positions corresponding to the holes 157 of the polishing table 130. With this arrangement, polishing liquid may be supplied onto an upper surface of the polishing pad 36 through the space 155, the holes 157 and the through-holes of the polishing pad 36.

Figure 10:
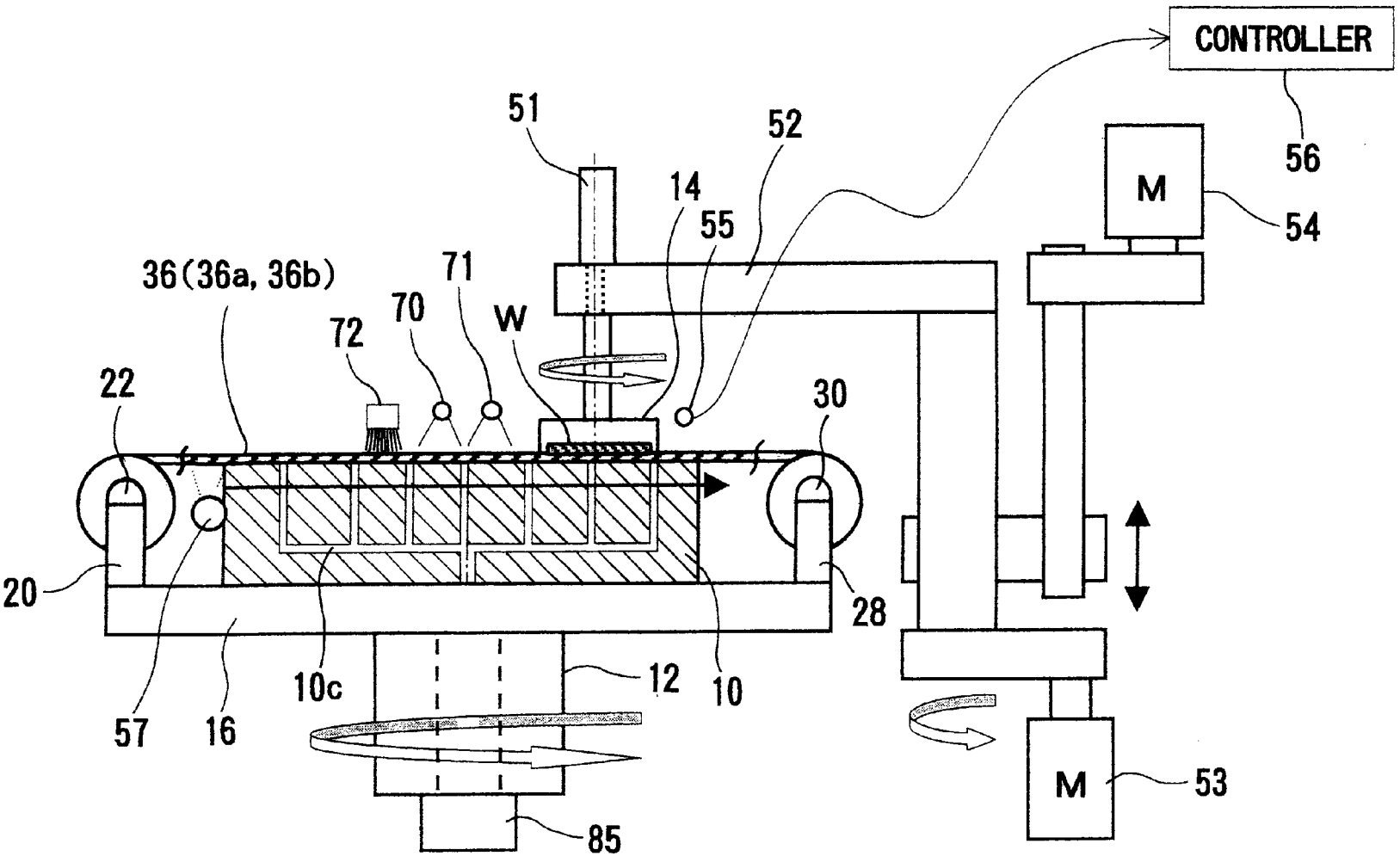
FIG. 10 is a front elevational view showing an essential part of a polishing apparatus according to a second embodiment of the present invention.
Figure 11:
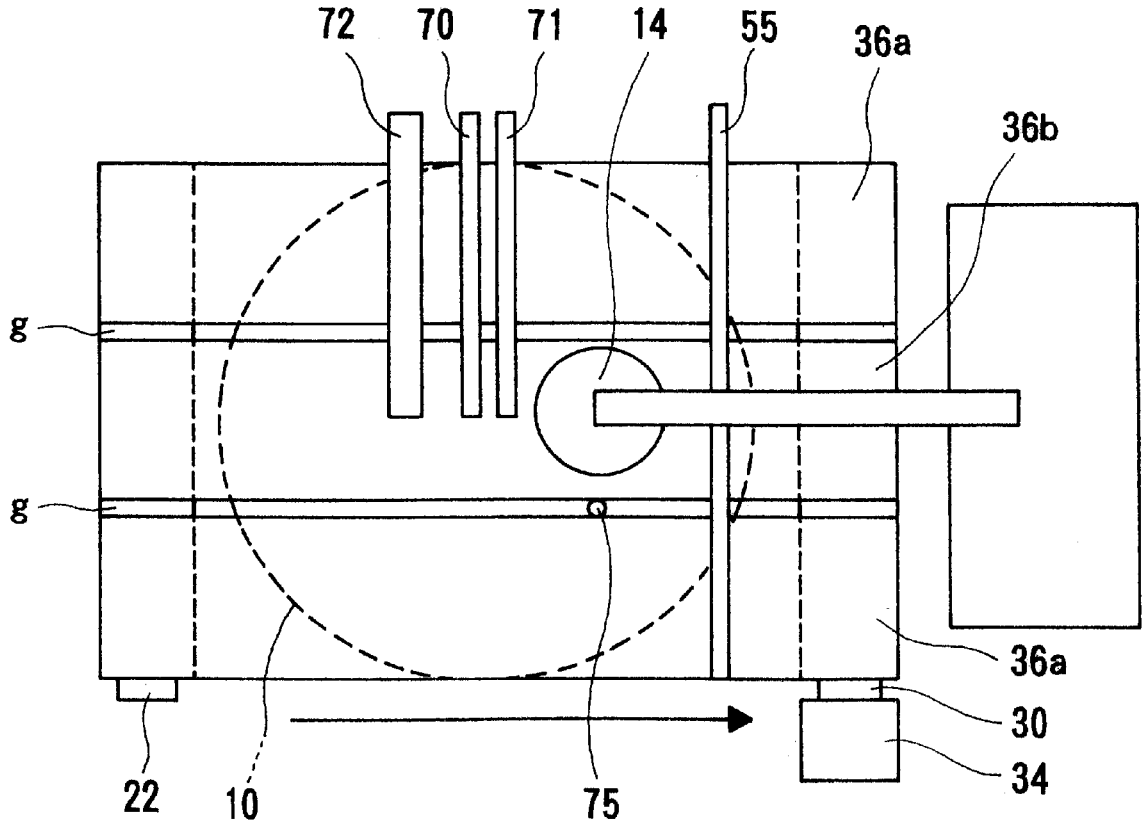
FIG. 11 is a plan view showing an essential part of the polishing apparatus according to the second embodiment of the present invention.

FIGS. 10 and 11 show an essential part of a polishing apparatus according to a second embodiment of the present invention, wherein FIG. 10 is a schematic cross-sectional view of the polishing apparatus and FIG. 11 is a plan view of the polishing apparatus. As shown in FIG. 10, the polishing apparatus comprises a circular planar polishing table 10, a motor 12 for rotating the polishing table 10, and a top ring 14 vertically movably disposed above the polishing table 10 for removably holding a substrate W such as a semiconductor wafer with its surface, to be polished, facing the polishing table 10. A support plate 16 is attached to a lower surface of the polishing table 10, and supports a supply roll 22 and a take-up roll 30 thereon through bearings 20, 28, respectively. The polishing table 10 is rotated about its own axis by the motor 12. While the substrate W is being polished, the take-up roll 30 is rotated by energizing a take-up roll motor 34 to cause the polishing pad 36 to travel along an upper surface of the polishing table 10 in a direction shown by an arrow. The polishing table 10 has a fluid passage 10*c* formed therein, and the fluid passage 10*c* is connected to a fluid source such as a compressed air source through a rotary connector 85. The fluid passage 10*c* is open at the upper surface of the polishing table 10, and when fluid is supplied to the fluid passage 10*c*, fluid such as compressed air is ejected from the upper surface of the polishing table 10.

With the above structure, during movement of the polishing pad 36, fluid such as compressed air is supplied to the fluid passage 10*c* from the fluid source, and then supplied fluid is ejected from the upper surface of the polishing table 10 toward the polishing pad 36. Thus, a frictional force between the polishing table 10 and the polishing pad 36 is reduced, and movement of the polishing pad 36 along the polishing table 10, i.e. automatic replacement of the polishing pad 36 can be smoothly conducted. When pressure of fluid ejected from the fluid passage 10*c* toward the polishing pad 36 is varied in accordance with a radial position of the substrate W, a pressing force applied between the substrate W and the polishing pad 36 can be changed at a central area and an outer circumferential area of the substrate W. Specifically, polishing pressure applied to the substrate W can be varied in accordance with positions in a radial direction of the substrate W to thus control a polishing profile.

In FIG. 10, an air cylinder 51 for moving the top ring 14 vertically, a swing arm 52 for angularly movably supporting the top ring 14, and a motor 53 for angularly moving the swing arm 52 are shown. Further, a motor 54 for rotating the top ring 14 about its own axis is also shown.

In the embodiment shown in FIG. 10, a sensor 55 for detecting a surface roughness of the polishing pad is provided downstream of a polishing surface of the polishing pad 36 (i.e. a side of the take-up roll 30). In the sensor 55, light is applied to the polishing surface of the polishing pad 36 by a light-emitting element, reflected light from the polishing surface of the polishing pad 36 is received by a light-detecting element, and surface roughness of the polishing pad 36 is detected on the basis of intensity of the reflected light received by the light-detecting element. The sensor 55 is connected to a controller 56, and when the sensor 55 detects wear of the polishing pad 36 and sends a signal to the controller 56, the take-up roll motor 34 is energized to rotate the take-up roll 30, and thus the polishing pad 36 is wound by a predetermined length. Further, a UV irradiating source 57 is provided below the polishing pad 36. In a case where a fixed abrasive pad is used as polishing pad 36, an ultraviolet ray is applied onto the polishing pad 36 from the UV irradiating source 57 to cause binder, for fixing abrasive particles of the abrasive pad, to deteriorate and to cause the abrasive particles of the polishing pad 36 to be liberated.

According to this embodiment, the polishing pad 36 comprises a plurality of sub-pads which are divided in a longitudinal direction thereof. Specifically, as shown in FIG. 11, two sub-pads 36*a* disposed at both sides, and a sub-pad 36*b* disposed at a central portion, are held by a common supply roll 22 and a common take-up roll 30, thus providing a plurality of polishing surfaces on the polishing table 10. By moving the top ring 14 between the two kinds of the sub-pads 36*a*, 36*b*, when substrate W held by the top ring 14 is positioned at a central portion of the polishing table 10, the substrate W is polished only by the sub-pad 36*b*, and when substrate W held by the top ring 14 is positioned at an outer peripheral portion of the polishing table 10, the substrate W is mainly polished by one of the sub-pads 36*a*. According to these divided-type polishing pads of the present invention, multi-stage polishing of substrate W can be conducted under different conditions on a single polishing table. At this time, a rotational speed of the polishing table 10 may be changed during a mid-portion of a polishing process, and a take-up speed of the sub-pads 36*a*, 36*b* may be varied during a mid-portion of a polishing process. Further, substrate W may be disposed on the sub-pads 36*a*, 36*b* simultaneously, and the substrate W may be polished in such a manner that the substrate W is brought into contact with different sub-pads at a central portion of an outer peripheral portion of the substrate W.

Polishing liquid supply nozzle 70 extends over the sub-pads 36*a* and 36*b*, and has a plurality of openings at positions corresponding to the sub-pads 36*a* and 36*b* so that a polishing liquid is supplied onto the sub-pads 36*a* and 36*b* simultaneously. A high-pressure pure water spray or atomizer 71 is disposed above the polishing table 10 and adjacent to the polishing liquid supply nozzle 70 so that high-pressure pure water, or a gas-liquid mixture (foggy mixture of pure water and nitrogen), can be sprayed therefrom. Thus, high-pressure pure water, or a gas-liquid mixture is sprayed over polishing surfaces of the sub-pads 36*a* and 36*b* by the high-pressure pure water spray or atomizer 71, for thereby conducting cleaning and dressing of the polishing surfaces. Further, a brush 72 having nylon bristles may be provided to remove ground-off material, produced during a polishing process, from the polishing surfaces as a kind of a dressing process.

According to this embodiment, as shown in FIG. 11, a gap g is provided between each sub-pad 36*a* and the sub-pad 36*b*. Thus, light emitted from optical sensor 75 (see FIG. 5), comprising a light-emitting element and a light-detecting element mounted in the polishing table 10, passes through one of the gaps g between one of the sub-pads 36*a* and the sub-pad 36*b* and is incident on a surface of the substrate W, and hence thickness of film on the substrate W can be measured when the substrate W passes above this gap g between the sub-pad 36*a* and the sub-pad 36*b*. After thickness of the film on the substrate W measured by the optical sensor 75 reaches a predetermined value, rotational speed of the top ring, rotational speed of the polishing table, and a pressing applied to the substrate W may be varied.

In a case where a thin polishing pad is used, a medium such as light, sound waves (acoustic emission), electromagnetic waves, or X-rays passes through the polishing pad, and hence by applying such medium to substrate W from a side of the polishing table, thickness of a film on the substrate W can be measured.

Next, structure of components associated with the polishing surface of polishing pad 36 will be described below.

If ground-off material or fine particles produced by polishing are attached to rolls or other rotating parts, a drive of such rolls or parts is adversely affected. Thus, in the polishing apparatus of the present invention, the following measures are taken: portions which are brought in sliding contact with each other are constructed from synthetic resin; portions which are brought in sliding contact with each other are coated with synthetic resin; portions from which dust is generated are exhausted; and portions from which dust is generated have a labyrinth structure. With this arrangement, fine particles are prevented from being scattered, or from adhering to driving portions.

Further, pressure in a polishing space in which a polishing table, a polishing pad and a top ring are disposed is set such that pressure decreases from high to low in the order of: a position where a substrate to be polished is located, a polishing position of the substrate; and a position where a polished substrate is located.

Figure 12:
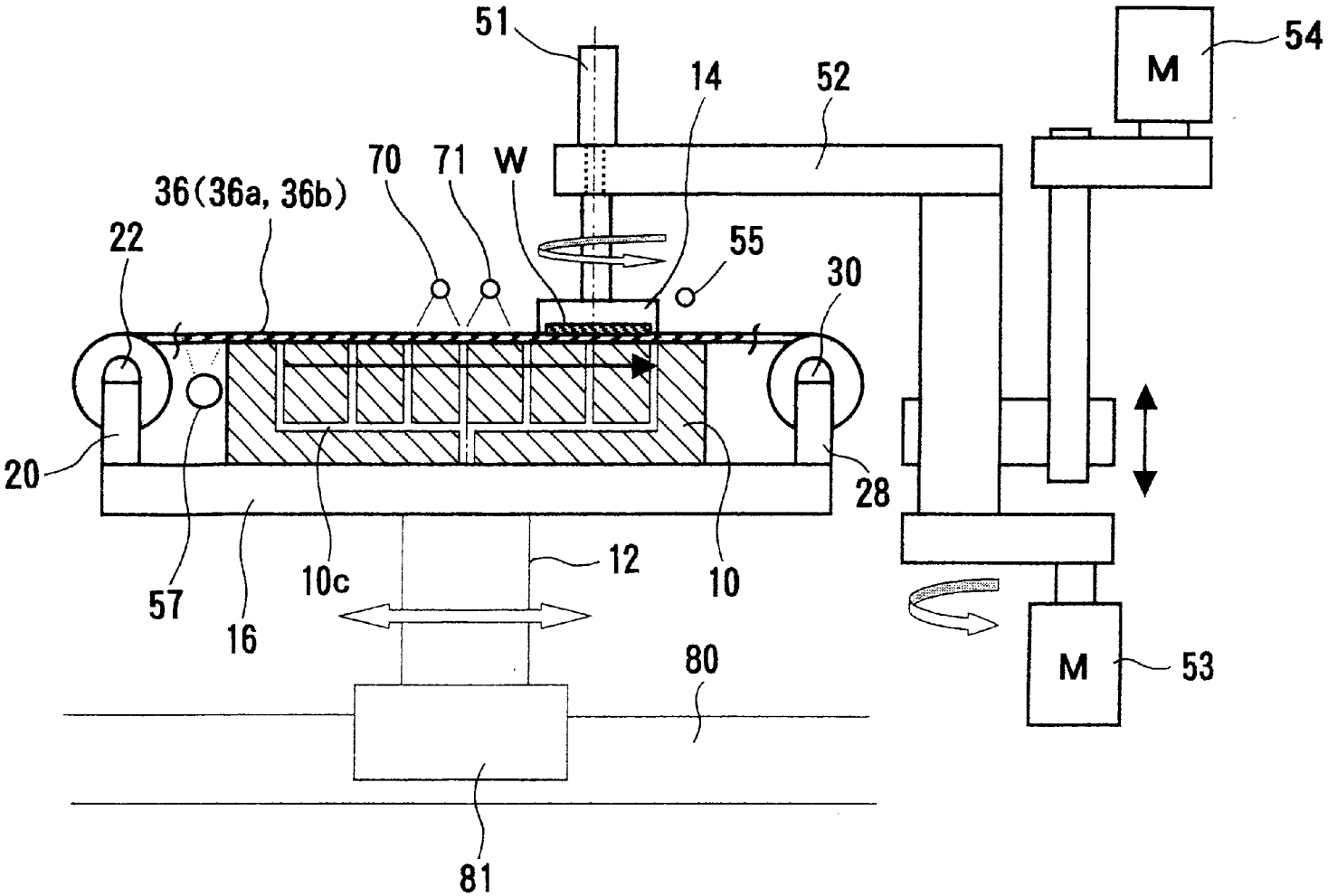
FIG. 12 is a front elevational view showing an essential part of a polishing apparatus according to a third embodiment of the present invention.
Figure 13:
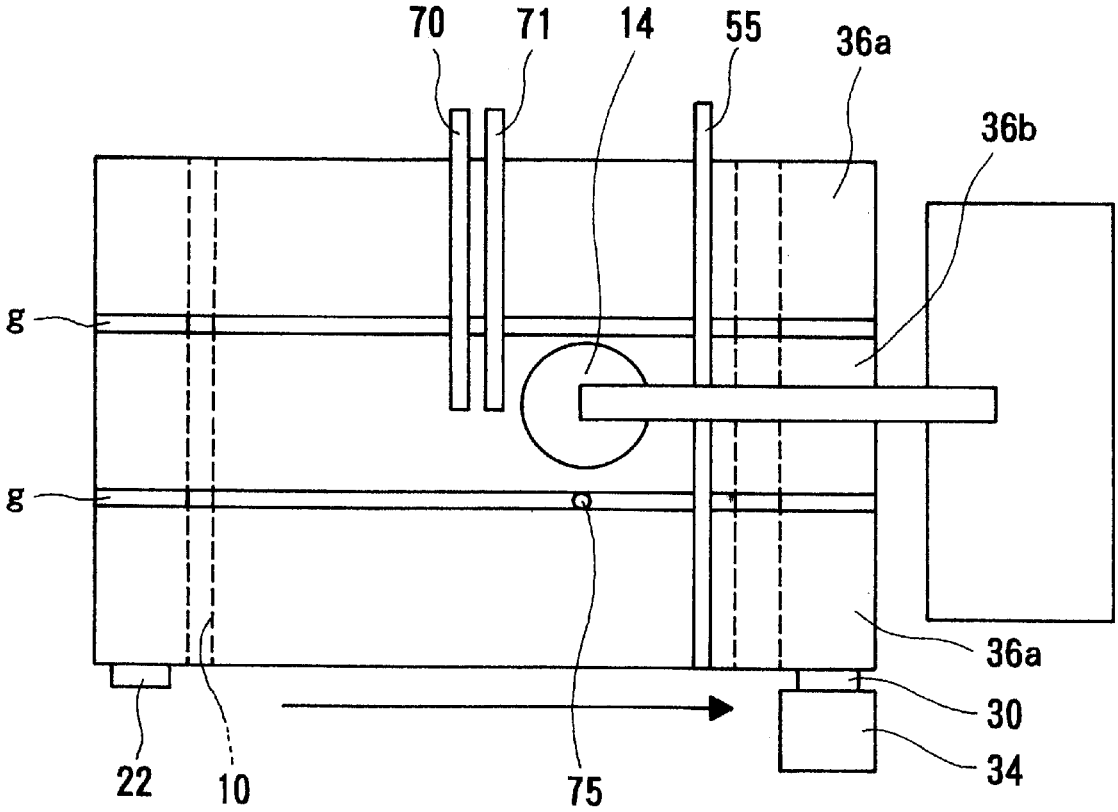
FIG. 13 is a plan view showing an essential part of the polishing apparatus according to the third embodiment of the present invention.

FIGS. 12 and 13 show an essential part of a polishing apparatus according to a third embodiment of the present invention, wherein FIG. 12 is a schematic cross-sectional view and FIG. 13 is a plan view. In the polishing apparatus of this embodiment, polishing table 10 makes a linear reciprocating motion in a horizontal direction.

The polishing table 10 comprises a rectangular planar table, and the polishing table 10 reciprocates linearly along a guide rail 80. A linear motor 81 is provided at a portion which supports the polishing table 10, and the polishing table 10 reciprocates along the guide rail 80 by energizing the linear motor 81. A ball screw may be used instead of the linear motor. Other construction of the polishing apparatus shown in FIGS. 12 and 13 is identical to the polishing apparatus shown in FIGS. 10 and 11. In the polishing apparatuses shown in FIGS. 10 through 13, the polishing pad may be attracted under vacuum to the polishing table.

Figure 14:
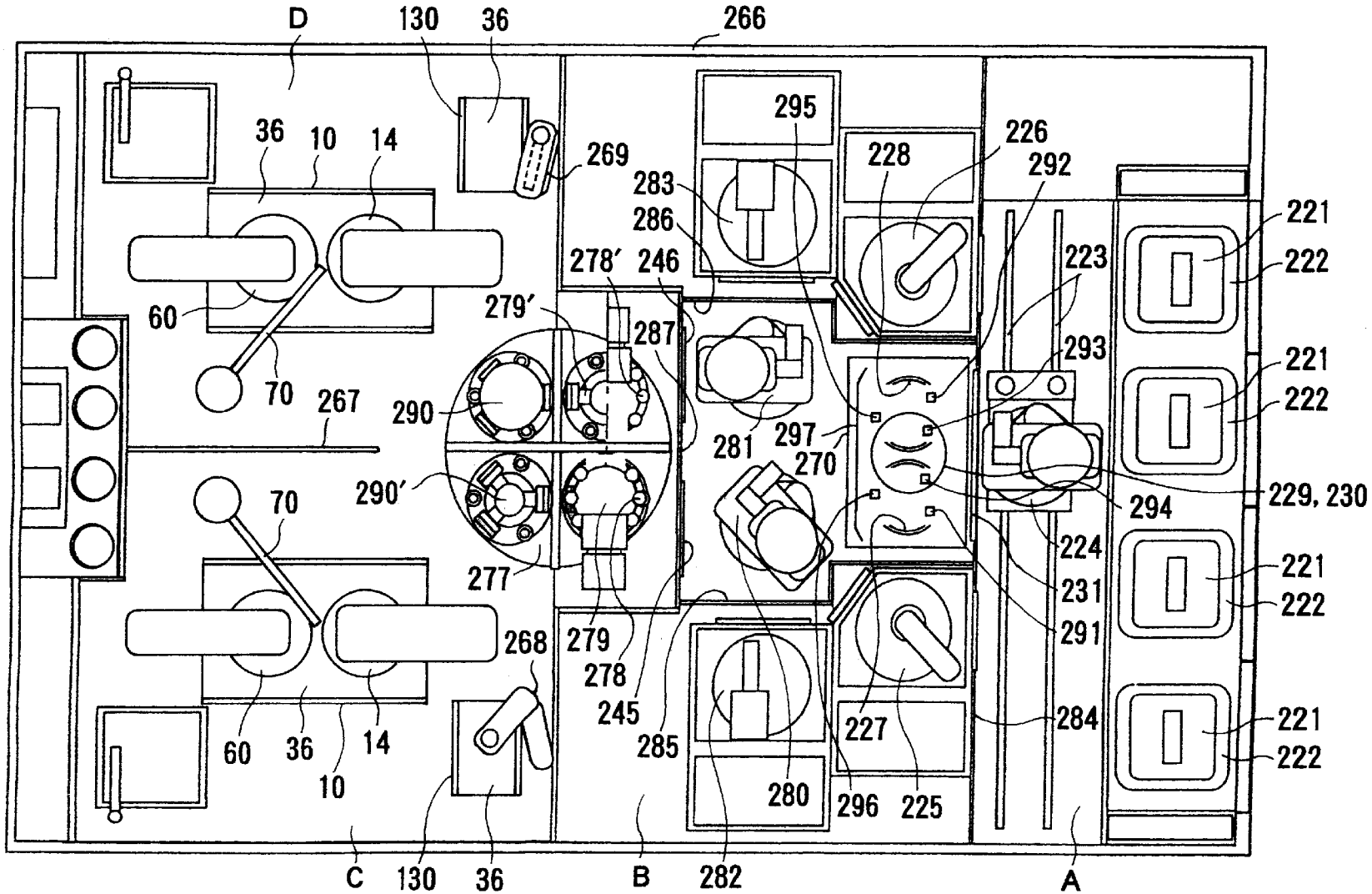
FIG. 14 is a plan view showing a layout of various components of a polishing apparatus according to an embodiment of the present invention.
Figure 15:
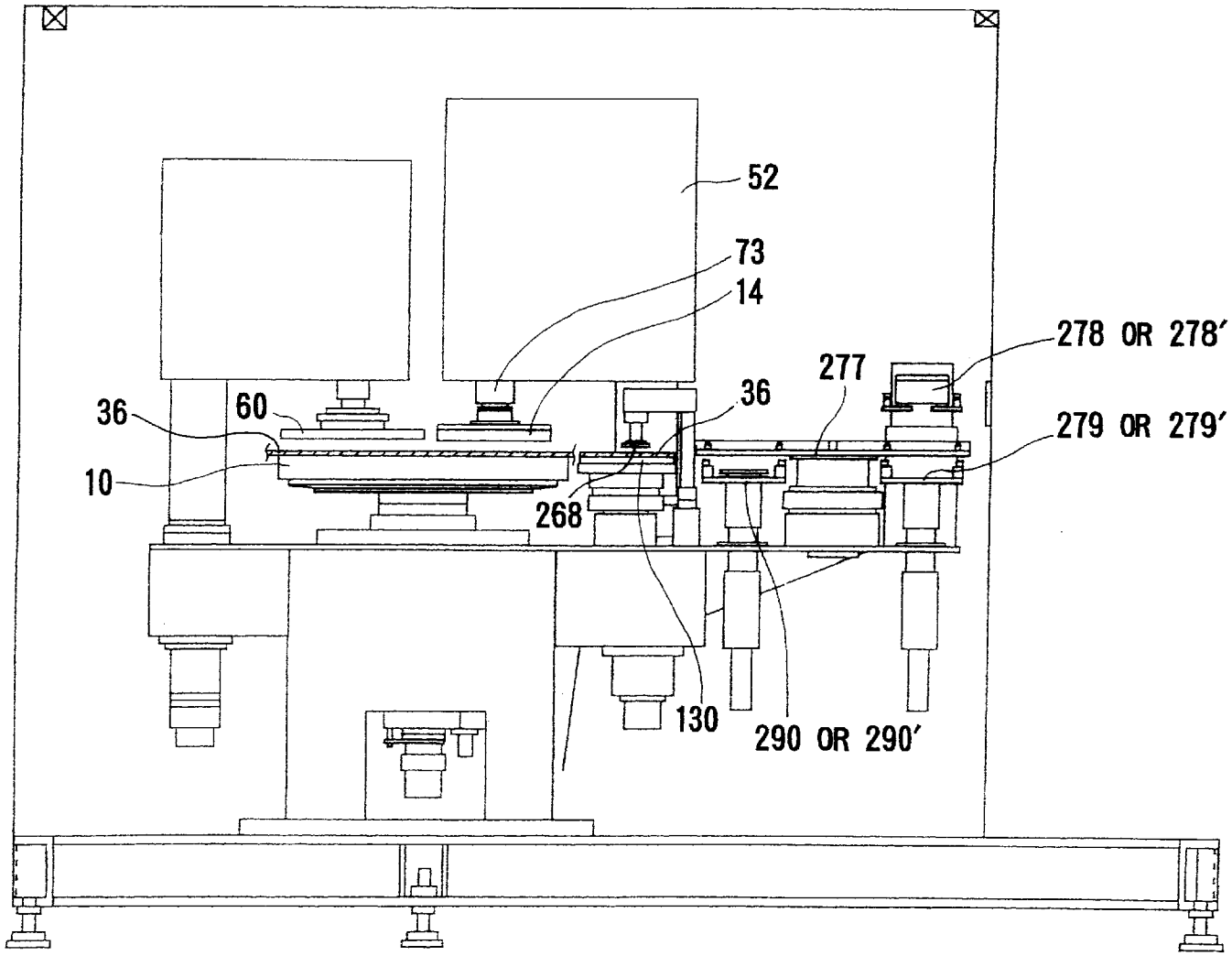
FIG. 15 is a view showing a relationship between a top ring and polishing tables of the polishing apparatus of FIG. 14.
Figure 16:
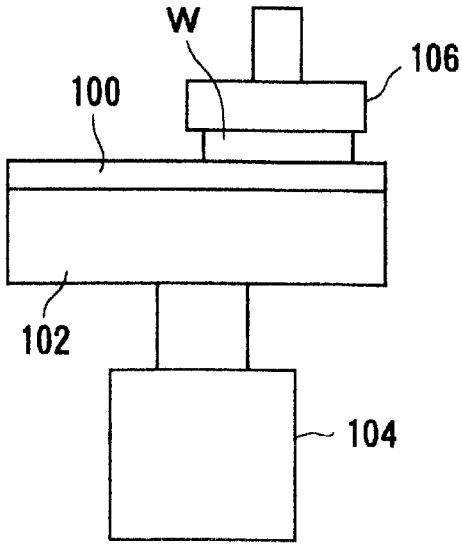
FIG. 16 is a front elevational view of a conventional polishing apparatus.
Figure 17:
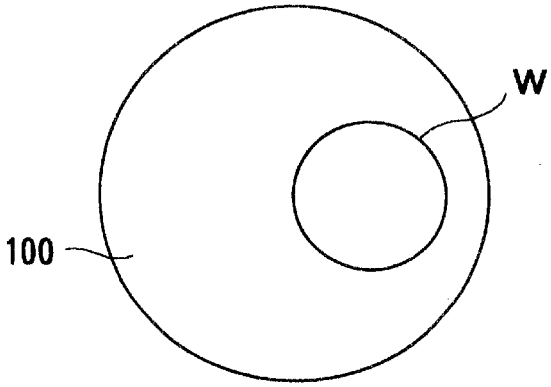
FIG. 17 is a plan view of the conventional polishing apparatus shown in FIG. 16.
Figure 18:
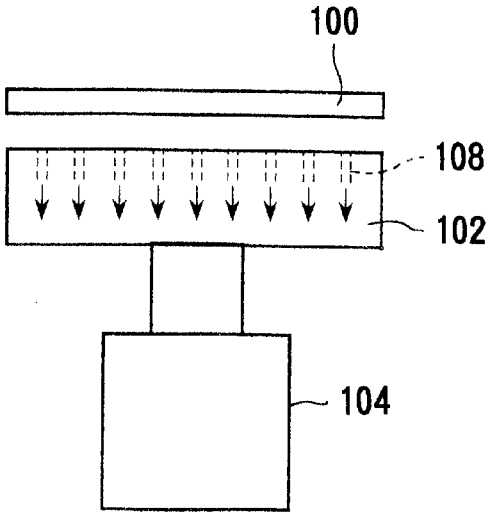
FIG. 18 is a front elevational view of another conventional polishing apparatus.
Figure 19:
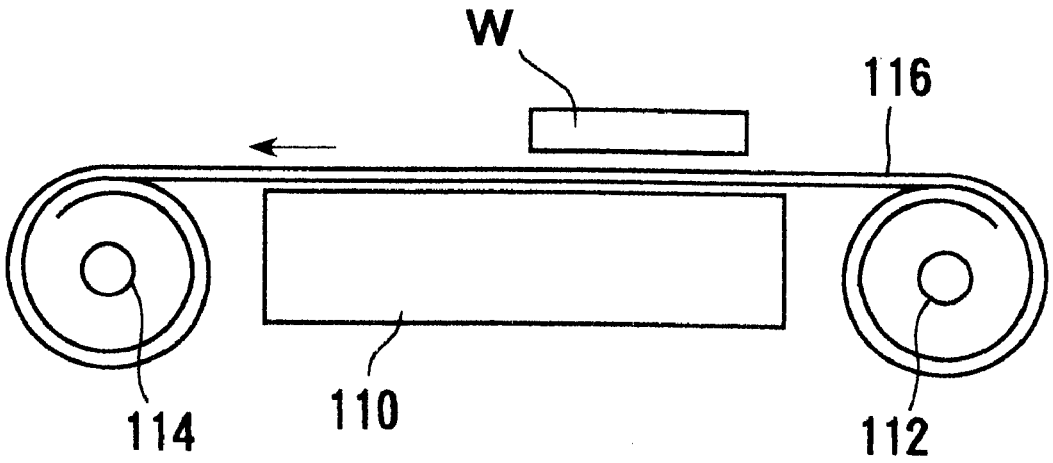
FIG. 19 is a front elevational view of still another conventional polishing apparatus.

FIG. 14 shows an entire structure of a polishing apparatus, and specifically a layout of various components of the polishing apparatus according to the present invention. FIG. 15 shows a relationship between top ring 14 and polishing tables 10 and 130. In this polishing apparatus, a fixed abrasive pad and/or a polishing pad made of polyurethane foam or the like shown in FIGS. 1 through 13, which can be automatically replaced, are used.

As shown in FIG. 14, a polishing apparatus according to the present invention comprises four load-unload stages 222 each for receiving a wafer cassette 221 which accommodates a plurality of substrates W such as semiconductor wafers. Each load-unload stage 222 may have a mechanism for raising and lowering a respective wafer cassette 221. A transfer robot 224 having two hands is provided on rails 223 so that the transfer robot 224 can move along the rails 223 and access respective wafer cassettes 221 on respective load-unload stages 222.

The transfer robot 224 has two hands which are located in a vertically spaced relationship, wherein a lower hand is used only for removing a substrate W from a wafer cassette 221 and an upper hand is used only for returning the substrate W to the wafer cassette 221. This arrangement allows that a clean semiconductor wafer which has been cleaned is placed at an upper side and is not contaminated. The lower hand is a vacuum attraction-type hand for holding a semiconductor wafer under vacuum, and the upper hand is a recess support-type hand for supporting a peripheral edge of a semiconductor wafer by a recess formed in the hand. The vacuum attraction-type hand can hold a semiconductor wafer and transport the semiconductor wafer even if the semiconductor wafer is not located at a normal position in a wafer cassette 221 due to a slight displacement, and the recess support-type hand can transport a semiconductor wafer while keeping the semiconductor wafer clean because dust is not collected, unlike the vacuum attraction-type hand. Two cleaning apparatuses 225 and 226 are disposed at an opposite side of the wafer cassettes 221 with respect to the rails 223 of the transfer robot 224. The cleaning apparatuses 225 and 226 are disposed at positions that can be accessed by the hands of the transfer robot 224. Between the two cleaning apparatuses 225 and 226 and at a position that can be accessed by the transfer robot 224, there is provided a wafer station 270 having four wafer supports 227, 228, 229 and 230. The cleaning apparatuses 225 and 226 have a spin-dry mechanism for drying a substrate by spinning the substrate at a high speed, and hence two-stage cleaning or three-stage cleaning of the substrate can be conducted without replacing any cleaning module.

An area B in which the cleaning apparatuses 225 and 226 and the wafer supports 227, 228, 229 and 230 are disposed, and an area A in which the wafer cassettes 221 and the transfer robot 224 are disposed, are partitioned by a partition wall 284 so that cleanliness of area B and area A can be separated. The partition wall 284 has an opening for allowing substrates W to pass 25 therethrough, and a shutter 231 is provided at the opening of the partition wall 284. A transfer robot 280 having two hands is disposed at a position where the hands of the transfer robot 280 can access the cleaning apparatus 225 and three wafer supports 227, 229 and 230, and a transfer robot 281 having two hands is disposed at a position where the hands of the transfer robot 281 can access the cleaning apparatus 226 and three wafer supports 228, 229 and 230.

The wafer support 227 is used to transfer a substrate W between the transfer robot 224 and the transfer robot 280 and has a sensor 291 for detecting whether or not a substrate W is present. The wafer support 228 is used to transfer a substrate W between the transfer robot 224 and the transfer robot 281 and has a sensor 292 for detecting whether or not a substrate W is present. The wafer support 229 is used to transfer a substrate W from the transfer robot 281 to the transfer robot 280 and has a sensor 293 for detecting whether or not a substrate is present, and rinsing nozzles 295 are provided for supplying a rinsing liquid to prevent a substrate W from drying or to conduct rinsing of a substrate W. The wafer support 230 is used to transfer a substrate W from the substrate robot 280 to the transfer robot 281 and has a sensor 294 for detecting whether or not a substrate W is present, and rinsing nozzles 296 are provided for supplying a rinsing liquid to prevent a substrate W from drying or to conduct rinsing of a substrate W. The wafer supports 229 and 230 are disposed in a common water-scatter-prevention cover which as an opening defined therein for transferring substrates therethrough, wherein the opening is combined with a shutter 297. The wafer support 229 is disposed above the wafer support 230, and the wafer support 229 serves to support a substrate which has been cleaned while the wafer support 230 serves to support a substrate to be cleaned, so that the cleaned substrate is prevented from being contaminated by rinsing water which would otherwise fall thereon. The sensors 291, 292, 293 and 294, the rinsing nozzles 295 and 296, and the shutter 297 are schematically shown in FIG. 14, and their positions and shapes are not illustrated exactly.

The transfer robot 280 and the transfer robot 281 each have two hands which are located in a vertically spaced relationship. Respective upper hands of the transfer robot 280 and the transfer robot 281 are used for transporting a substrate W, which has been cleaned, to the cleaning apparatuses or the wafer supports of the wafer station 270, and respective lower hands of the transfer robot 280 and the transfer robot 281 are used for transporting a substrate W which has not been cleaned or a substrate W to be polished. Since each lower hand is used to transfer a substrate to or from a reversing device, each upper hand is not contaminated by drops of a rinsing water which fall from an upper wall of a reversing device.

A cleaning apparatus 282 is disposed at a position adjacent to the cleaning apparatus 225 and is accessible by the hands of the transfer robot 280, and another cleaning apparatus 283 is disposed at a position adjacent to the cleaning apparatus 226 and is accessible by the hands of the transfer robot 281.

All the cleaning apparatuses 225, 226, 282 and 283, the wafer supports 227, 228, 229 and 230 of the wafer station 270, and the transfer robots 280 and 281 are placed in area B. Pressure in area B is adjusted so as to be lower than pressure in area A. Each of the cleaning apparatuses 282 and 283 is capable of cleaning both surfaces of a substrate.

The polishing apparatus has a housing 266 for enclosing various components therein. An interior of the housing 266 is partitioned into a plurality of compartments or chambers (including areas A and B) by partition walls 284, 285, 286 and 287.

A polishing chamber separated from area B by the partition wall 287 is formed, and is further divided into two areas C and D by a partition wall 267. In each of areas C and D, there are provided two polishing tables, and a top ring for holding a substrate W and pressing the substrate W against the polishing tables. That is, one polishing table 10 (see FIG. 1) and one polishing table 130 (see FIG. 8) are provided in area C, and another polishing table 10 (see FIG. 1) and another polishing table 130 (see FIG. 8) are provided in area D. Further, one top ring 14 is provided in area C and another top ring 14 is provided in area D. One polishing liquid supply nozzle 70 for supplying a polishing liquid to polishing table 10 in area C and one dresser 60 (see FIG. 3) for dressing this polishing table 10 are disposed in area C. Another polishing liquid supply nozzle 70 for supplying a polishing liquid to the polishing table 10 in area D and another dresser 60 (see FIG. 3) for dressing this polishing table 10 are disposed in area D. A dresser 268 for dressing polishing table 130 in area C is disposed in area C, and a dresser 269 for dressing polishing table 130 in area D is disposed in area D. The polishing tables 130 and 130 may be replaced with wet-type thickness measuring devices for measuring a thickness of a layer on a substrate. If such wet-type thickness measuring devices are provided, then they can measure a thickness of a layer on a substrate immediately after the substrate is polished, and hence it is possible to further polish the polished substrate or control a polishing process for polishing a subsequent substrate based on a measured value.

As shown in FIG. 14, in area C separated from area B by partition wall 287 and at a position that can be accessed by the hands of the transfer robot 280, there is provided a reversing device 278 for reversing a semiconductor wafer, and at a position that can be accessed by the hands of the transfer robot 281, there is provided a reversing device 278' for reversing a substrate W. The partition wall 287 between area B and areas C, D has two openings each for allowing substrates to pass therethrough, one of which openings is used for transferring a substrate W to or from the reversing device 278 and the other of which openings is used for transferring a substrate W to or from the reversing device 278'. Shutters 245 and 246 are provided at respective openings of the partition wall 287.

The reversing devices 278 and 278' each have a chuck mechanism for chucking a substrate W, a reversing mechanism for reversing a substrate W, and a wafer detecting sensor for detecting whether or not the chuck mechanism chucks a substrate W. The transfer robot 280 transfers a substrate W to the reversing device 278, and the transfer robot 281 transfers a substrate W to the reversing device 278'.

As shown in FIGS. 14 and 15, a rotary transporter 277 is disposed below the reversing devices 278 and 278' and top ring 14 (in area C) and top ring 14 (in area D), for transferring substrates W between a cleaning chamber (area B) and a polishing chamber (areas C and D). The rotary transporter 277 has four stages for placing substrates W at equal angular intervals, and can hold a plurality of substrates thereon at the same time.

A substrate W which has been transported to the reversing device 278 or 278' is transferred to a lifter 279 or 279' disposed below the rotary transporter 277 by actuating the lifter 279 or 279' when a center of a stage of the rotary transporter 277 is aligned with a center of the substrate W held by the reversing device 278 or 278'. The substrate W which has been transported to the lifter 279 or 279' is transferred to the rotary transporter 277 by lowering the lifter 279 or 279'. The substrate W placed on a stage of the rotary transporter 27 is transported to a position below top ring 14 (in area C) or top ring 14 (in area D) by rotating the rotary transporter 277 by an angle of 90°. At this time, the top ring 14 (in area C) or the top ring 14 (in area D) is positioned above the rotary transporter 277 beforehand by a swinging motion thereof.

The substrate W is transferred from the rotary transporter 277 to a pusher 290 or 290' disposed below the rotary transporter 277, and finally the substrate W is transferred to the top ring 14 (in area C) or the top ring 14 (in area D) by actuating the pusher 290 or 290' when a center of the top ring 14 (in area C) or the top ring 14 (in area D) is aligned with a center of the substrate placed on the rotary transporter 277.

The substrate transferred to the top ring 14 (in area C) or the top ring 14 (in area D) is held under vacuum by vacuum attraction mechanism of this top ring, and transported to the polishing table (in area C) or the polishing table 10 (in area D). Thereafter, the substrate is polished by a polishing surface comprising a polishing pad made of polyurethane foam or the like, or a fixed abrasive pad held by this polishing table 10. In a case where a polishing pad made of polyurethane foam or the like and/or a fixed abrasive pad according to the present invention are used, a polished surface of the substrate having very few scratches can be obtained during a first-stage polishing. Polishing tables 130 and 130 are disposed at positions that can be accessed by the top rings 14 and 14, respectively. With this arrangement, a primary polishing of the substrate W can be conducted by one of the polishing tables 10, and then a finish polishing of the substrate W is conducted by a finish polishing pad held by a corresponding one of the polishing tables 130. With this polishing table 130, finish polishing of the substrate is conducted by a polishing pad comprising SUBA400 or POLITEX (manufactured by Rodel Nitta) while supplying pure water onto the polishing pad or supplying slurry onto the polishing pad. Alternatively, primary polishing of a substrate can be conducted by the polishing table 130 or 130, and then secondary polishing of the substrate can be conducted by a corresponding one of polishing table 10 or 10. In this case, since the polishing table 130 has a smaller-diameter polishing surface than does the polishing table 10, a fixed abrasive pad which is more expensive than a polishing pad made of polyurethane foam or the like is attached to the polishing table 130 to thereby conduct a primary polishing of the substrate. On the other hand, a polishing pad made of polyurethane foam or the like having a shorter life, but being cheaper than a fixed abrasive pad, is held by the polishing table 10 to thereby conduct a finish polishing of the substrate. This arrangement or utilization may reduce a running cost of the polishing apparatus. If a polishing pad made of polyurethane foam or the like is held by the polishing table 10 and a fixed abrasive pad is held by the polishing table 130, then this polishing table system may be provided at a lower cost. This is because the fixed abrasive pad is more expensive than the polishing pad made of polyurethane foam or the like, and price of the fixed abrasive pad is substantially proportional to a diameter of the fixed abrasive pad. Further, since a polishing pad made of polyurethane foam or the like has a shorter life than that of a fixed abrasive pad, if the polishing pad is used under a relatively light load such as a finish polishing, then life of the polishing pad is prolonged. Further, if a diameter of a polishing pad is large, chance or frequency of contact with a substrate is distributed to thus provide a longer life, a longer maintenance period, and an improved productivity of semiconductor devices.

As described above, according to one aspect of the present invention, even when a polishing table is in motion such as rotary motion or circulatory motion, a polishing pad can be transported from one roll over an upper surface of a polishing table toward another roll by a distance corresponding to a region of the polishing pad that has been used to polish workpieces. The used region of the polishing pad can thus automatically be replaced with a new region of the polishing pad.

Furthermore, according to another aspect of the present invention, a polishing pad is supplied from a polishing pad supply device, and the supplied polishing pad is held by a polishing pad holding device and placed in an elongate state on a polishing table. Thus, even if the polishing table is in motion, a used region of the polishing pad can thus automatically be replaced with a new region of the polished pad.

Although certain preferred embodiments of the present invention have been shown and described in detail, it should be understood that various changes and modifications may be made therein without departing from the scope of the appended claims.

What is claimed is:

1. A polishing apparatus comprising:

a polishing table;

a top ring for removably holding a workpiece to be polished, said top ring being positionable so as to face said polishing table;

a first roll and a second roll each rotatable about its own axis, said first and second rolls being movable in unison with said polishing table;

a polishing pad which is to be unwound from said first roll and supplied in a take-up direction over a surface of said polishing table toward said second roll so as to be wound about said second roll;

a motor connected to at least said scond roll;

a sensor for detecting surface roughness of said polishing pad so as to generate a detection signal corresponding to wear of said polishing pad; and a controller connected to said motor for energizing said motor in accordance with said detection signal so as to rotate said second roll such that said polishing pad is advanced in the take-up direction from said first roll toward said second roll.

2. The polishing apparatus according to claim 1, wherein said polishing table has a fluid passage formed therein for receiving fluid from a fluid source connected to said fluid passage and ejecting the fluid toward said polishing pad when said polishing pad is positioned over the surface of said polishing table.

3. The polishing apparatus according to claim 2, wherein said fluid passage is constructed and arranged such that pressure of the fluid ejected from said fluid passage is variable in accordance with a radial position of a workpiece when located on said polishing pad.

4. The polishing apparatus according to claim 1, wherein said sensor comprises a light-emitting element for applying light to said polishing pad, and a light-detecting element for receiving light reflected from said polishing pad, and said sensor is for detecting surface roughness of said polishing pad based on intensity of the light received by said light-detecting element.

5. The polishing apparatus according to claim 1, wherein said polishing table has an attraction section for attracting and holding said polishing pad to the surface of said polishing table.

6. The polishing apparatus according to claim 1, wherein said polishing pad comprises one of a polyurethane foam pad and a suede type pad.

7. The polishing apparatus according to claim 1, wherein said polishing pad comprises a fixed abrasive pad including embedded abrasive particles.

8. The polishing apparatus according to claim 7, further comprising a UV irradiating source for allowing said abrasive particles to be liberated.

9. The polishing apparatus according to claim 1, wherein said polishing pad comprises sub-pads which are separated from one another along the take-up direction.

10. The polishing apparatus according to claim 9, wherein said sub-pads are separated from one another along the take-up direction by a gap.

11. The polishing apparatus according to claim 10, further comprising an optical sensor for detecting thickness of a film on the workpiece, said optical sensor including a light-emitting element for applying light to the workpiece and a light-detecting element for receiving light reflected from the workpiece, wherein said optical sensor is for detecting thickness of-the film on the workpiece based on intensity of the light received by said light-detecting element.

12. The polishing apparatus according to claim 11, wherein said optical sensor is disposed such that light emitted from said light-emitting element passes through the gap between said sub-pads before being applied to the workpiece.

13. The polishing apparatus according to claim 1, further comprising a brush for removing material generated during polishing of the workpiece with said polishing pad.

14. The polishing apparatus according to claim 1, further comprising an atomizer for spraying a gas-liqiud mixture onto said polishing pad.

15. The polishing apparatus according to claim 1, further comprising an eddy-current sensor for monitoring thickness of a film on the workpiece.

16. The polishing apparatus according to claim 1, further comprising an optical sensor for detecting thickness of a film on the workpiece, said optical sensor including a light-emitting element for applying light to the workpiece and a light-detecting element for receiving light reflected from the workpiece, wherein said optical sensor is for detecting thickness of the film on the workpiece based on intensity of the light received by said light-detecting element.

* * * * *